US007374853B2

(12) United States Patent
Takenouchi

(10) Patent No.: US 7,374,853 B2
(45) Date of Patent: May 20, 2008

(54) ORGANIC PHOTORECEPTOR AND AN IMAGE FORMING METHOD USING THE SAME

(75) Inventor: Shigeki Takenouchi, Chofu (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 390 days.

(21) Appl. No.: 11/002,841

(22) Filed: Dec. 2, 2004

(65) Prior Publication Data

US 2006/0121376 A1 Jun. 8, 2006

(51) Int. Cl.
*G03G 13/08* (2006.01)

(52) U.S. Cl. ..... 430/120.1

(58) Field of Classification Search ..... 430/110.3, 430/110.4, 120, 120.1
See application file for complete search history.

(56) References Cited

U.S. PATENT DOCUMENTS

| | | | | |
|---|---|---|---|---|
| 4,987,046 | A | 1/1991 | Kutami et al. | |
| 5,783,344 | A | 7/1998 | Kobayashi et al. | |
| 5,888,684 | A | 3/1999 | Kobayashi et al. | |
| 7,183,035 | B2 * | 2/2007 | Tomoyori | 430/120 |
| 7,202,005 | B2 * | 4/2007 | Tomoyori | 399/159 |
| 2001/0044062 | A1 | 11/2001 | Toshiyuki et al. | |
| 2001/0044063 | A1 | 11/2001 | Hamaguchi et al. | |
| 2003/0198879 | A1 * | 10/2003 | Shirose et al. | 430/45 |
| 2006/0088776 | A1 * | 4/2006 | Asano et al. | 430/45 |
| 2006/0099524 | A1 * | 5/2006 | Takenouchi | 430/56 |

FOREIGN PATENT DOCUMENTS

| | | | |
|---|---|---|---|
| EP | 0 915 386 | A1 | 5/1999 |
| JP | 1-315781 | | 12/1989 |
| JP | 4-74570 | A | 3/1992 |
| JP | 5-45925 | A | 2/1993 |
| JP | 10-268541 | | 10/1998 |
| JP | 10-268544 | | 10/1998 |
| JP | 10-277480 | A | 10/1998 |
| JP | 10-288914 | | 10/1998 |
| JP | 11-143129 | A | 5/1999 |
| JP | 11-143292 | A | 5/1999 |
| JP | 2000-131887 | A | 5/2000 |
| JP | 2000-242011 | | 8/2000 |
| JP | 2001-154393 | | 8/2001 |

(Continued)

OTHER PUBLICATIONS

Abstract of JP 2003270810.*

*Primary Examiner*—Hoa Le
(74) *Attorney, Agent, or Firm*—Frishauf, Holtz, Goodman & Chick, P.C.

(57) ABSTRACT

Disclosed is a photoreceptor comprising a cylindrical substrate and a photosensitive layer. The substrate wherein the cylindrical substrate has a cylindricity of 5 to 40 μm, and the photoreceptor satisfies the relation of $$0<(PWS/P^2)<5.0\times10^{-4}\ \mathrm{mm}^{-1},$$

wherein PWS is an average value of power spectrum values of regular reflection light amount in a region of a space frequency from 0 to 2 $\mathrm{mm}^{-1}$ measured at the wave length of imagewise exposing light to the photoreceptor, and P is an average value of reflection light at the measuring point of the photoreceptor.

An image forming method employing the photoreceptor is also disclosed, which comprises developing a latent image formed on the photoreceptor, with a developer comprising a toner including toner particles having a variation coefficient of shape coefficient of not more than 16%.

14 Claims, 7 Drawing Sheets

FOREIGN PATENT DOCUMENTS

| | | | |
|---|---|---|---|
| JP | 2001-249480 | | 9/2001 |
| JP | 2002-023421 | | 1/2002 |
| JP | 2002-049164 | A | 2/2002 |
| JP | 2002-131948 | A | 5/2002 |
| JP | 2002-162762 | A | 6/2002 |
| JP | 2002-236381 | | 8/2002 |
| JP | 2002-107985 | | 10/2002 |
| JP | 2002-6523 | A | 7/2003 |
| JP | 2003270810 | * | 9/2003 |

* cited by examiner

FIG. 3 ( a )
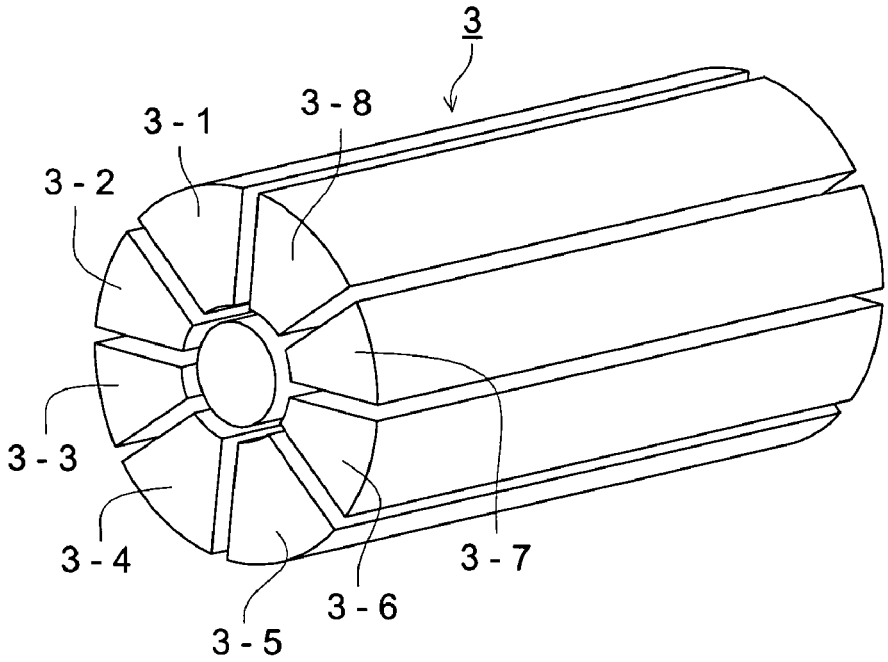
FIG. 3 ( b )
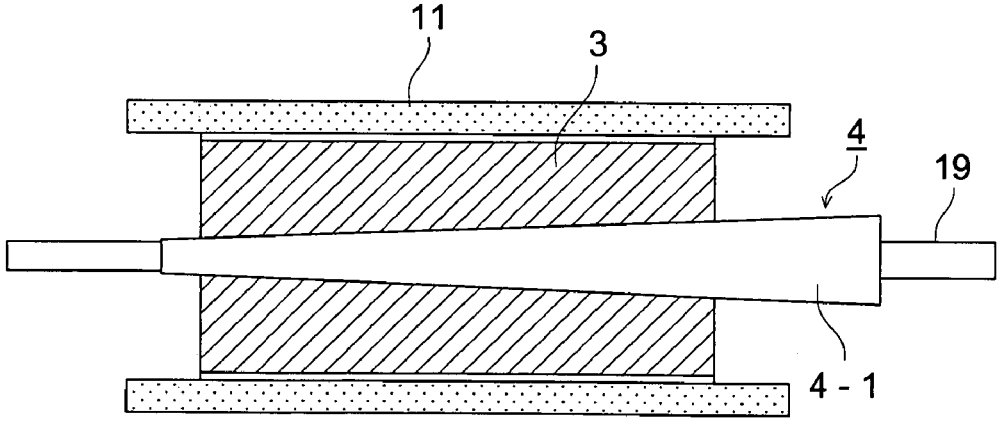

TONER HAVING NO CORNERS

TONER HAVING CORNERS

TONER HAVING CORNERS

ORGANIC PHOTORECEPTOR AND AN IMAGE FORMING METHOD USING THE SAME

FIELD OF THE INVENTION

The present invention relates to an organic photoreceptor, an image forming method and an image forming apparatus using for an electrophotographic copying machine or printer.

RELATED ART

Recently, one comprising a thin layer of an organic photoreceptor containing an organic photoconductive substance formed on an electroconductive substrate, hereinafter referred to as a photoreceptor, is most widely employed for image carrier of an electrophotographic image forming apparatus. The organic photoreceptor is advantageous compared with another photoreceptor in respect that a material corresponding to various light sources from visible light to infrared light easily can be developed, a material not contaminating the environment can be selected and the production cost is low.

Besides, a digital image formation is become to the mainstream of the image forming method of the electrophotographic system accompanied with the recent progress in the digital technology. It is widely performed in the digital image forming method that a small dot image of one pixel such as 400 ndpi, dpi is a number of the dot per 2.54 cm, is imaged. Consequently, technique for exactly reproducing such the small dot is demanded.

Generally, when image wise exposing light of a LD or a LED is irradiated to a thin layer formed on an electroconductive substrate such as aluminum reflecting light, an interference effect is caused by the difference in the pass of the incident light directly absorbed to the light arrived to the substrate after incidence and reflected and then re-reflected by the surface of the layer toward interior of the layer and absorbed or to the light passing through multiple reflection course. The organic photoreceptor relating to the invention is not exception to such the phenomenon. Particularly, in a cylindrical photoreceptor frequently employed in an electrophotographic image forming apparatus for forming numerous copy images, unevenness of the layer thickness tends to occur since the layer is coated by a liquid coating method such as an immersion coating method so that the interference effect tends to be increased. The interference effect is intensified by the difference of the light pass length caused by the unevenness in the layer thickness when the layer has the unevenness in the thickness near the wavelength of the exposing light so that unevenness of the image density so called moiré stripe is appeared on the image.

For reducing the moiré strip, almost complete prevention of the reflected light or reduction of the unevenness in the layer thickness so as to occur no interference is considered in principle. However, in the practical case, the complete prevention of the reflected light from the electroconductive substrate is difficult particularly in the organic photoreceptor, and the interference effect is considerably caused in a function separation type photoreceptor in which a light permeable CTL is provided as an upper layer and a CGL is provided near the electroconductive substrate.

It has been found by the investigation by the inventors that the moiré stripe is increased by the unevenness in the layer thickness caused by the unevenness of the surface finishing of the substrate other than the thickness unevenness caused by the coating and drying of the layer when unevenness exists in the surface finishing of the cylindrical electroconductive substrate. It has been found that the unevenness of the surface finishing of the substrate frequently causes the moiré stripe since the accuracy of the surface finishing to be held is not cleared yet.

Hitherto, the prevention of the reflection on the substrate and the reduction of the unevenness in the layer thickness are tried against such the problem, but satisfactory effect cannot be obtained by either methods.

Recently, it is found that polymerized toner is effective for raising the image quality, and high resolution and gradation reproducibility can be attained, which cannot be attained hitherto, by the use of the polymerized toner. It is considered that such the image quality raising effect can be obtained since monodispersed particles having uniform particle diameter can be easily obtained in the polymerized toner even though the particle diameter of such the toner is as small as from 3 to 7 μm. However, not only the moiré stripe is come into prominence but the quality of dot image constituting a digital image is posed as a problem in a high resolution quality image using the polymerized toner. A problem is raised that, in the high quality image, the gradation of the halftone image cannot be sufficiently obtained when the dot line constituting the halftone image is not preciously reproduced even when the resolution is high.

Moreover, the organic photoreceptor has large contacting energy with the toner of the image formed by the development of the static latent image. Consequently, various problems tend to be posed on the cleaning of the toner remaining on the photoreceptor after the transfer of the toner image onto an image receiving material. The insufficiency of the cleaning is also relates to the unevenness in the layer thickness of the organic photoreceptor, and the insufficiency of the cleaning tends to occur on a photoreceptor having large unevenness in the layer thickness.

SUMMARY OF THE INVENTION

An object of the invention is to solve the foregoing problem and to provide a cylindrical organic photoreceptor capable of forming an image in which reproducibility in the halftone image is high and the moiré stripe is not conspicuous, and an image forming method and an image forming apparatus capable of forming an electrophotographic image with high sharpness in which the moiré stripe is not conspicuous and the satisfactory cleaning ability of the toner is maintained for a long period when the organic photoreceptor and the polymerized toner are employed in combination.

It is found by the inventors that the cylindricity is dominant factor among the finishing precisions of the cylindrical electroconductive substrate for preventing the occurrence of the moiré and the fault in the cleaning which tend to occur when a digital electrophotographic image with high sharpness using the toner having a relatively uniform particle size distribution such as the polymerized toner, and for improving the image reproducibility of the half tone image. It is effective to use a cylindrical electroconductive substrate finished so as to make the cylindricity within a specified range, to reduce the deviation of the thickness of the layer covering the substrate, and to reduce the power spectrum of the reflected light amount in low space frequency region.

The organic photoreceptor according to the invention is suitable to form a high quality electrophotographic image by employing a toner such as the polymerized toner in which the shape factor and the particle size distribution are relatively uniform.

The invention is described.

An organic photoreceptor comprising a cylindrical substrate and a photosensitive layer formed on the substrate, wherein the cylindrical substrate has a cylindricity of from 5 to 40 μm, and the relation between an average value PWS of the power spectrum values of the regular reflection light amount in the region of the space frequency of from 0 to 2 $mm^{-1}$ measured at the wave length $\lambda_m$ of the imagewise exposing light and an average value P of the reflection light at the measuring point satisfies the following relation of formula 1.

$$0<(PWS/P^2)<5.0\times10^{-4}\ mm^{-1} \quad 1$$

An organic photoreceptor preferably comprises an under coat layer between the substrate and the photosensitive layer. The under coat layer may preferably contain inorganic particles having a number average primary particle diameter of from 0.02 to 0.5 μm.

It is preferable that $(PWS/P^2)$ is preferably not larger than $1.0\times10^{-4}\ mm^{-1}$.

The deviation of layer thickness of the layer covering the substrate in the substantial image forming area is preferably from 0.2 to 2.0 μm.

The photoreceptor of the present invention is applied to an image forming method comprising the steps of forming a static latent image on an organic photoreceptor by charging and imagewise exposing, forming toner image by converting the static latent image to a toner image by a developing process, for transferring the toner image to an image receiving material, and for cleaning the toner remaining on the photoreceptor after the transferring the toner image.

The following toner is preferably employed in the image forming method in combination with the photoreceptor of the present invention.

A toner in which the sum M of the relative frequency $m_1$ of the toner particle included in the class containing largest number of the particles and the relative frequency $m_2$ of the toner particles included in the class containing secondary number of the particles is not less than 70% in a histogram representing the particle size distribution based on the number, in the histogram, the natural logarithm lnD of the diameter of toner particle D in μm is measured on the horizontal axis and the horizontal axis is divided every 0.23.

A toner having ratio (Dv50/Dp50) from 1.0 to 1.15, wherein (Dv50) is the 50% volume particle diameter and (Dp50) is the 50% number particle diameter.

A toner having ratio (Dv75/Dp75) from 1.00 to 1.12, wherein Dv75 is the cumulative 75% volume particle diameter from the maximum diameter of the toner particle and Dp75 is the cumulative 75% number particle diameter.

A toner containing toner particles having variation coefficient of the shape coefficient of not more than 16% and number variation coefficient of number distribution of particle diameter of 27%.

BRIEF DESCRIPTION OF THE DRAWING

FIG. 3(*a*) is a perspective view showing one example of supporting member.

FIG. 3(*b*) is a sectional view showing one example of a pressure control device to a supporting member.

FIGS. 9(*b*) and 9(*c*) are schematic views showing toner particle having corner.

DETAILED DESCRIPTION OF THE INVENTION

Figure 1:
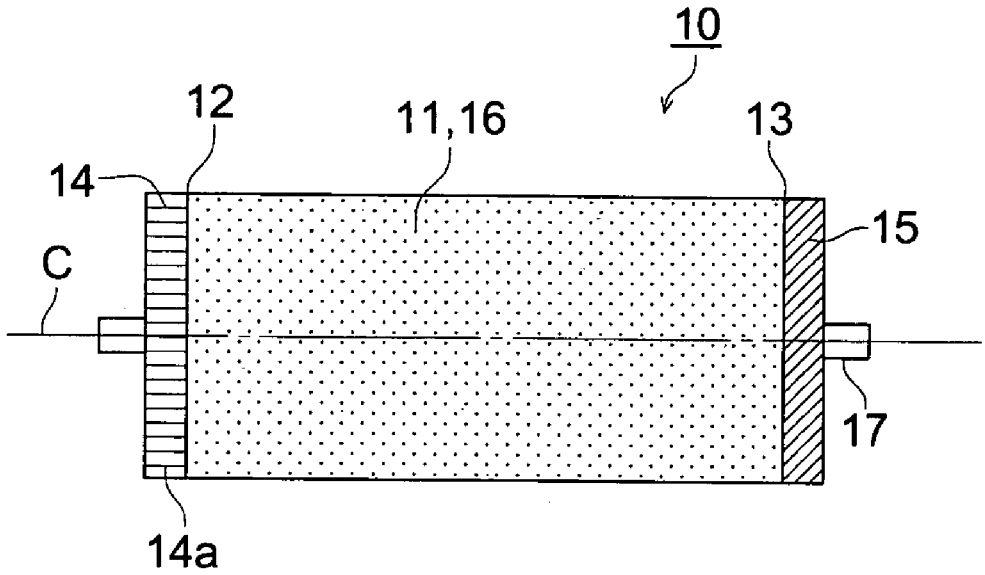
FIG. 1 is a schematically front view illustrating one example of a photoreceptor according to the invention.

The invention is described in detail below.

The organic photoreceptor comprising a cylindrical substrate and a photosensitive layer formed on the substrate, wherein the cylindrical substrate has a cylindricity of from 5 to 40 μm, and the relation between an average value PWS of the power spectrum values of the regular reflection light amount in the region or the space frequency of from 0 to 2 $mm^{-1}$ measured at the wave length $\lambda_m$ of the imagewise exposing light and an average value P of the reflection light at the measuring point satisfies the following relation of Formula 1.

$$0<(PWS/P^2)<5.0\times10^{-4}\ mm^{-1} \quad \text{Formula 1}$$

The occurrence of moiré is considerably improved and the thickness of the layer covering the substrate is uniformly formed in the organic photoreceptor in which the cylindricity of the cylindrical substrate is made to 5 to 40 μm, and the thickness deviation of the layer covering the substrate in the circumference direction and axis direction is reduced and the following Formula 1 is satisfied. Consequently, the cleaning characteristics is improved and the moiré stripe is made inconspicuous and the insufficient cleaning caused passing the toner under the cleaning blade does not occur even when the toner having uniform shape produced by a polymerization method is employed so that an electrophotographic image reproducing a suitable halftone image with high sharpness can be obtained.

It is preferable for decreasing the average value PWS of the power spectrum of the reflected light that a substance capable of scattering the exposing light is added into the layer covering the substrate of the photoreceptor for reducing the amount of the reflected light. Generally, photoreceptor has an under coat layer, a photosensitive layer such as a charge generation layer and a charge transfer layer, and a protective layer according to necessity; it is preferable to add the substance capable of scattering the exposing light into the under coat layer or the photosensitive layer. It is also effective to scatter the exposing light by roughing the surface of the cylindrical substrate.

The organic photoreceptor comprises the cylindrical substrate and the photosensitive layer and the under coat layer on the substrate, wherein the cylindricity of the cylindrical substrate is from 5 to 40 μm, the under coat layer contains inorganic particle having a number average primary particle diameter of from 0.02 to 0.5 μm, and the relation between an average value PWS of the power spectrum values of the regular reflection light amount in the region or the space frequency of from 0 to 2 $mm^{-1}$ measured at the wave length $\lambda_m$ of the imagewise exposing light and an average value P of the reflection light at the measuring point satisfies the foregoing relation of Formula 1.

In the organic photoreceptor, the cylindricity of the cylindrical substrate is made to 5 to 40 μm, the thickness deviation of the layer covering the substrate is reduced and the under coat layer containing inorganic particle having a number average premier particle diameter of from 0.02 to 0.5 μm is provided so that the foregoing Formula 1 is satisfied. Accordingly, the occurrence of the moiré is considerably improved in such the cylindrical photoreceptor, and the cleaning characteristics is improved since the uniformity of the thickness of the layer covering the substrate is high. Therefore, the moiré stripe is become inconspicuous and the insufficient cleaning caused passing the toner under the cleaning blade does not occur even when the toner having uniform shape produced by a polymerization method is employed so that an electrophotographic image reproducing a suitable halftone image with high sharpness can be obtained.

Preferable examples of the inorganic particle having a number average of premier particle diameter of from 0.02 to 0.5 μm are a fine particle of a metal oxide, copper sulfate, zinc sulfate and titanium oxide. The titanium oxide is particularly preferred since a fine particle having various crystal shapes, particle diameters and surface treated states can be chosen according to the using object. Such the inorganic particle is preferably employed in the under coat layer for also improving the property of blocking the injection of electron from the substrate to the under coat layer. The content of the metal oxide in the under coat layer is preferably from 3% to 50% of the entire weight of the under coat layer, and the thickness of the under coat layer is preferably from 0.5 to 20 μm.

When the under coat layer and the photosensitive layer contain no light scattering substance, the value of $(PWS/P^2)$ tends to be made larger than $5.0\times10^{-4}$ $mm^{-1}$. In such the case, the moiré occurs easily even if the cylindricity of the cylindrical substrate is within the range of from 5 to 40 μm and the deviation of the layer thickness is reduced. Moreover, a drawback such as lacking of the smoothness of the halftone image tends to occur. The value of $(PWS/P^2)$ is preferably not more than $1.0\times10^{-4}$ $mm^{-1}$.

In the invention, it is preferable that the cylindricity of the cylindrical substrate is made into the range of from 5 to 40 μm and the deviation of the layer thickness in the circumference direction and the axis direction of the photoreceptor is made into the range of from 0.2 to 2.0 μm. Generally, it is difficult to make the deviation of the layer thickness to less than 0.2 μm since the organic photoreceptor is manufactured by coating a coating liquid on the electroconductive substrate. On the other hand, when the deviation of the layer thickness in the circumference and the axis directions is more than 2.0 μm, the moiré tends to occur and the insufficiency of the cleaning caused by passing the toner under the cleaning blade tends to occur even since irregularity of the photoreceptor surface is become larger even if the value of $(PWS/P^2)$ is smaller than $5.0\times10^{-4}$ $mm^{-1}$. The measuring methods of the deviation of the layer thickness and the value of $(PWS/P^2)$ are described below.

Measuring Method of Layer Thickness Deviation

In the invention, the deviation of layer thickness in the substantial image forming area is the deviation of the layer covering the substrate in the surface area of the cylindrical organic photoreceptor where imagewise irradiated by the exposing light on the occasion of image formation by the image forming apparatus, and the concrete imagewise exposing area can be defined by the by the axis direction width of the cylindrical organic photoreceptor.

As the practical method, the layer thickness is measured at every 10 mm in the axis direction and every 10 mm in the circumference direction at the central portion of the image area of the cylindrical organic photoreceptor and the difference of the maximum value and the minimum value in the entire measured values is defined as the thickness deviation of the layer covering the substrate according to the invention.

Though the layer thickness is measured by an eddy current type layer thickness meter Fischerscope Type Eddy 560C, the measuring apparatus is not limited as long as the apparatus has the same measuring accuracy.

Measuring Method of the $(PWS/P^2)$ Value

The power spectrum is determined by Fourier transforming the irregular varying values of the reflected light amount measured at 243 points by a laser displacement meter LC2400 manufactured by Kyense Co., Ltd., arranged at the position of regular reflection in the direction.

The reflection light amount is measured at 81 points namely at every 0.5 mm extended over 40 mm (±20 mm of the center point of the axis direction of the photoreceptor) at the central portion of the axis direction of the photoreceptor, the same measurement is repeated at 81 points moved by +0.1 mm in the circumference direction and at 81 points moved by −0.1 mm in the circumference direction. Thus total number of the measuring point is become 243 points.

The average value of the reflected light P amount relating to the invention is calculated according to the following expression when the reflected light amount at each of the measuring points is represented by $P_{ij}$ in which i is an integer of from 1 to 3 and j is an integer of from 0 to 80.

$$P = \frac{1}{3\times 81}\sum_{i=1}^{3}\sum_{j=0}^{80} P_{ij}$$

The function of 81 irregular varying values measured at the 81 points is transformed to a Fourier function (a function obtained as the synthesis of sine waves having various frequency each different in the phase and the amplitude). The Fourier transformation is performed according to the following discrete Fourier transformation expression.

$$F_n^i = \frac{1}{L}\sum_{j=0}^{80} \Delta P_{ij}\sin\left(\frac{\pi\cdot\Delta x\cdot x_j}{L}\cdot n\right)$$

In the above expression, L is the distance of measuring area of 40 mm, $\Delta_x$ is the distance between the measuring point of 0.5 mm, $x_j$ is the order of measurement of from 0 (start) to 80 (end), n is n of the space frequency (n/40 $mm^{-1}$) and is an integer of from 0 to 80, and $\Delta_{ij}$ is the reflected light amount at each of the measuring points and the average value of the reflected light amount expressed by the following expression.

$$\Delta P_{ij} = P_{ij} - P$$

In the above measuring condition, the space frequency relating to the invention is expressed by (n/40 $mm^{-1}$). The average value PWS of the reflected light amount power spectrum in the range of from 0 to 2 $mm^{-1}$ (n is 0 to 80) relating to the invention can be calculated by the following expression employing above obtained function $F^i_n$.

$$PWS = \frac{1}{3}\sum_{i=1}^{3}|F_n^i|^2$$

The measurement of the reflected light amount is carried out under the following conditions.

The laser displacement meter LC2400 (wavelength of the laser light is 680 nm), manufactured by Keystone Co., Ltd., is adjusted so that the distance between the pointed end of the sensor and the photoreceptor surface is not more than 10 μm, and the laser light is irradiated along the axis direction in the regular reflection (45°) and the reflected light amount is measured.

The wavelength $\lambda_m$ of the exposing light relating to the invention is the wavelength $\lambda_m$ of single wavelength light widely applied for the latent image formation of digital image, and in concrete the wavelength of the exposing light of the light source when a laser (LD) or a light emission diode (LED). The effect of the invention or the moiré preventing effect is considerable when the LD is employed for the exposing light source; the light emitted from the LD has even phase and the moiré tends to be caused by such the light.

The organic photoreceptor is an electrophotographic photoreceptor which contains an organic compound showing at least one of the charge generation function and the charge transfer function essential for the electrophotographic photoreceptor. There are a photoreceptor constituted by the organic charge generation material or the charge transfer material, and a photoreceptor constituted by a polymer complex having the charge generation function and the charge transfer function.

A photoreceptor having a structure in which an under coat layer, a charge generating layer and a charge transport layer are provided on an electroconductive substrate in this order, or a charge generating/transport layer having functions of charge generating/transport in a single layer, is an example of preferable photosensitive layer. The photoreceptor may have a protective layer at the outermost.

Conductive Support

A conductive support in a cylindrical shape forms images endless by rotation, and it is preferably a conductive support having a straightness not greater than 0.1 mm and a run-out not greater than 0.1 mm. If the straightness and the run-out exceed these ranges, satisfactory image forming is difficult.

As a material to be used for the conductive support, there are given metal drums of aluminum, nickel, and the like, or plastic drums evaporated with aluminum, tin oxide, indium oxide, and the like, or paper/plastic drums coated with a conductive material. A conductive support preferably has a specific resistance equal to or smaller than $10^3$ Ωcm at a normal temperature.

Under Coat Layer

The under coat layer comprises inorganic particles having a number average primary particle diameter of 0.02 to 0.5 μm between the electrically conductive substrate and the photosensitive layer in the organic photoreceptor. The number average diameter of primary particles is defined by the value measured as the average diameter in the fere direction by image analysis of 100 particles randomly selected from the electron microscopic photograph of the fine particles with a magnification of 10,000.

The particles contained in the under coat layer is a metal oxide such as titanium oxide ($TiO_2$), zinc oxide (ZnO), and tin oxide ($SnO_2$), copper sulfide zinc sulfide and so on, and preferably an Titanium oxide particle. A fine particle of titanium oxide $TiO_2$, zinc oxide $ZnO_2$ and tin oxide $SnO_2$ are suitable in concrete. Among them, titanium oxide is preferable and a Titanium oxide particle surface-treated for giving a high dispersion suitability is more preferable. A particle of titanium oxide subjected to the surface treatment is particularly preferred. The content of the particle in the under coat layer is preferably from 10 to 90%, more preferably from 25 to 75%, by volume.

The surface treatment of the titanium oxide particle means to cover the surface of the particle by the metal oxide, a reactive organic silicon compound or an organic metal compound. The surface treatment of the Titanium oxide particle preferably applied in the invention is described below.

One of preferable surface treatments for the titanium oxide particle is a treatment in which plural times of treatment are performed and the last treatment thereof is carried out by the reactive organic silicon compound.

Another preferable surface treatment for the titanium oxide particle is a treatment by methylhydrogen-polysiloxane.

Another preferable surface treatment for the Titanium oxide particle is a treatment by an organic silicon compound having a fluorine atom.

The photoreceptor having an under coat layer containing surface treated titanium oxide has an improved characteristics of residual potential, inhibition of black spots generation without deteriorating electrophotographic characteristics, and inhibition of moiré generation.

The titanium oxide having number average primary particle diameter of 0.02 to 0.5 μm is preferably employed, which has good stability of dispersion to reduce power spectrum at special frequency of 0 to 2 $mm^{-1}$, and minimizes moiré generation The shape of titanium oxide includes a branched-shape, a needle-shape and a granule-shape. The crystal type of the titanium oxide particle having such the shapes includes an anatase-type, a rutile-type and an amorphous-type. Titanium oxide having any shape and any crystal type may be used, and a mixture of two or more kinds of titanium oxide each different from the other in the shape and the crystal type are also may be used.

In one of the surface treatments to be applied to the titanium oxide particle, plural times of treatments are applied and the last treatment of the plural treatments is carried out by the reactive organic silicon compound. It is preferred that at least on of the foregoing plural times of surface treatments is performed by the use of one or more kinds of compound selected from alumina $Al_2O_3$, silica $SiO_2$ and zirconia $ZrO_2$, and the surface treatment by the reactive organic silicon compound is performed at last. The compounds include their hydrate.

In another surface treatments to be applied to the titanium oxide particle, plural times of treatments are applied and the last treatment of the plural treatments is carried out by alumina or silica and then reactive organic titanium or zirconium compound. It is preferred that at least on of the foregoing plural times of surface treatments is performed by the use of one or more kinds of compound selected from alumina $Al_2O_3$, silica $SiO_2$ and zirconia $ZrO_2$, and the surface treatment by the reactive organic titanium or zirconium compound is performed at last.

The surface of the titanium oxide particle is uniformly covered with applying two or more times of the surface treatment as above components. The dispersibility of the titanium oxide particle in the under coat layer is improved by the use of such the surface-treated titanium oxide particle in the under coat layer and a suitable photoreceptor inhibited in the formation of image defect such as the black spot can be produced.

It is particularly preferable that plural times of treatments by alumina or silica are applied and then by the reactive organic silicon compound, or plural times of treatments by alumina or silica are applied and then by the reactive organic titanium or zirconium compound.

It is particularly preferred that the alumina treatment is performed at first and followed by the silica treatment, even though both of the treatments may be simultaneously applied. In the case of the alumina and silica treatments are separately applied, it is preferred that the amount of the silica is larger than that of the alumina.

The surface treatment of the titanium oxide by the metal oxide such as alumina, silica and zirconia can be performed by a wet method. For example, the surface treatment by the alumina, silica or zirconia can be performed as follows.

When the anatase type titanium oxide is employed, the titanium oxide particles having a number average premier particle diameter of 50 nm was dispersed in from 50 to 350 g of water to form aqueous slurry, and a water-soluble silicate or a water-soluble aluminum compound was added to the slurry. And then the slurry is neutralized by adding an alkali or an acid so as to separate silica or alumina onto the surface of the titanium oxide particle. Thereafter, the titanium oxide particles are filtered, washed and dried to obtain the objective surface treated titanium oxide. When sodium silicate is employed as the water-soluble silicate, the neutralization can be carried out by an acid such as sulfuric acid and hydrochloric acid. When aluminum sulfate is used as the water-soluble aluminum compound, the neutralization can be carried out by an alkali such as sodium hydroxide and potassium hydroxide.

The amount of the metal oxide to be used for the surface treatment is preferably from 0.1 to 50 parts, more preferably from 1 to 10 parts, by weight to 100 parts by weight of the titanium oxide in terms of the weight on the occasion of the start of the surface treatment. In the foregoing case using the alumina and silica for the surface treatment of the anatase type titanium oxide, it is preferably that the alumina and silica are each employed in an amount of from 1 to 10 parts by weight to 100 parts of the titanium oxide, respectively, and the amount of the silica is preferably larger than that of the alumina.

The surface treatment of the titanium oxide by the reactive organic silicon compound followed by the treatment by the metal oxide can be performed by a wet method, as follows.

The titanium oxide treated by the metal oxide is added to the reactive organic silicon compound dissolved or suspended in organic solvent or water, and they are stirred for a period of from several minutes to about one hour. The resulting liquid, which may be subjected to heat treatment if necessary, is filtered and filtrate is dried to obtain titanium oxide covered with reactive organic silicon compound. The reactive organic silicon compound may be added to titanium oxide dispersion in organic solvent or water.

It is confirmed that the surface of titanium oxide is covered with the reactive organic silicon compound by a combination of surface analysis method such as electron spectroscopy for chemical analysis (ESCA), Auger electron spectroscopy, secondary ion mass spectrometry (SIMS) and scatter reflection FI-IR.

The amount of the reactive organic silicon compound to be employed for the surface treatment is from 0.1 to 10, and preferably from 0.1 to 5, parts by weight to 100 parts by weight of the anatase type titanium oxide on the occasion of the surface treatment. By such the treatment, sufficient rectification effect, dispersing ability, photographic properties, remaining potential and charging potential can be obtained.

Examples of the reactive organic silicon compound are ones represented by the following Formula 1. The compound is not limited to the followings as long as the compound is capable of condensing reacting with the reactive group at the surface of titanium oxide such as a hydroxyl group.

Formula 11

$$(R)_n—Si—(X)_{4-n} \qquad 11$$

In the above formula, Si is a silicon atom, R is an organic group directly bonded to the silicon atom, X is a hydrolysable group and n is an integer of from 0 to 3.

Examples of the organic group represented by R which is directly bonded with the silicon include an alkyl group such as a methyl group, an ethyl group, a propyl group, a butyl group, a pentyl group, an octyl group and a dodecyl group; an aryl group such as a phenyl group, a tolyl group, a naphthyl group and a biphenyl group; an epoxy-containing group such as a γ-glycidoxypropyl group and a β-(3,4-epoxycyclohexyl)ethyl group; a (meth)acryloyl-containing group such as a γ-acryloxypropyl group and a γ-methacryloxypropyl group, a hydroxyl-containing group such as a γ-hydroxypropyl group and a 2,3-dihydroxypropyloxypropyl group; a vinyl-containing group such as a vinyl group and a propenyl group; a mercapto-containing group such as a γ-mercaptopropyl group; an amino-containing group such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluorooctylethyl group; a nitro- or cyan-substituted alkyl group. Examples of the hydrolyzable group represented by A include an alkoxyl group such as a methoxy group and an ethoxy group, a halogen and an acyloxy group.

The organic silicon compounds represented by Formula 2 may be employed singly or in a combination of two or more kinds thereof.

In the organic silicon compound represented by Formula 2, plural groups each represented by R may be the same as or different from each other when n is 2 or more. Plural groups represented by X may be the same as or different from each other when n is 2 or more. When two or more kinds of the organic silicon compounds represented by Formula 2 are employed, groups each represented by R and X of the individual compounds may be the same as or different from each other.

Examples of the compound in which n is 0 are as follows: tetrachlorosilane, diethoxydichlorosilane, tetramethoxy-silane, phenoxytrichlorosilane, tetraacetoxysilame, tetraethoxysilane, tetraallyoxysilane, tetrapropoxysilane, tetrakis (2-methoxyethoxy)silane, tetrabutoxysilane, tetraphenoxysilane, tetrakis(2-ethylbutoxy)silane and tetrakis(2-ethylhexyloxy)silane.

Examples of the compound in which n is 1 are as follows: trichlorosilane, methyltrichlorosilane, vinyltrichloro-silane, ethyltrichlorosilane, allyltrichlorosilane, n-propyltrichlorosilane, n-butyltrichlorosilane, chloromethylmethotrimethoxysilane, mercaptomethyl-trimethoxysilane, trimethoxyvinylsilane, ethyltrimethoxy-silane, 3,3,4,4,5,5,6,6,6-nonafluorohexyltrichlorosilane, phenyltrichlorosilane, 3,3,3-trifluoropropyl-trimethoxysilane, 3-chloropropyltrimethoxysilane, triethoxysilane, 3-mercaptopropyltrimethoxysilane, 3-aminopropyltrimethoxysilane, 2-aminoethylaminometyltrimethoxysilane, benzyltrichlorosilane, methyltriacetoxysilane, chloromethyltriethoxysilane, ethyltriacetoxysilane, phenyltrimethoxysilane, 3-allylthiopropyltrimethoxysilane, 3-glycidoxypropyltrimethoxysilane, 3-bromopropyltriethoxysilane, 3-allyaminopropyltrimethoxysilane, propyltriethoxysilane, hexyltritrimethoxysilane, 3-aminopropyltriethoxysilane, 3-methacryloxypropyltrimethoxysilane, bis(ethylmethylketoxime) methoxymethylsilane, octyltriethoxysilane and dodecyltriethoxysilane.

Examples of the compound in which n is 2 are as follows: dimethyldichlorosilane, dimethoxymethylsilane, dimethoxydimethylsilane, methyl-3,3,3-trifluoropropyldichlorosilane, diethoxysilane, diethoxymethylsilane, dimethoxymethyl-3,3,3-trifluoropropylsilane, chloromethyldiethoxysilane, diethoxydimethylsilane, dimethoxy-3-mercaptopropylmethylsilane, 3,3,4,4,5,5,6,6,6-nonafluorohexylmethyldichlorosilane, diacetoxymethylvinylsilane, diethoxymethylvinylsilane, 3-methacryloxypropylmethyldichlorosoilane, 3-(2-aminoethylaminopropyl)dimethoxymethylsilane, t-butylphenyldichlorosilane, 3-methacryloxypropyldimethoxymethylsilane, 3-(2-acetoxyethylthiopropyl)dimethoxymethylsilane, dimethoxymethyl-2-piperidinoethylsilane, dibutoxydimethylsilane, 3-dimethylaminopropyldiethoxymethylsilane, diethoxymethylphenylsilane, diethoxy-3-glycidoxypropylmethylsilane, 3-(3-acetoxyporopylthio)propyldimethoxymethylsilane, dimethoxymethyl-3-piperidinopropylsilane and diethoxymethyloctadecylsilane.

Examples of the compound in which n is 3 are as follows: trimethylchlorosilane, methoxytrimethylsilane, ethoxytrimethylsilane, methoxydimethyl-3,3,3-trifluoropropylsilane, 3-chloropropylmethoxydimethylsilane and methoxy-3-mercaptopropylmethylmethylsilane.

Preferable examples of the organic silicon compound represented by Formula 2 are represented by the following Formula 2.

Formula 12

$$R—Si—(X)_3 \qquad 12$$

In the above, R is an alkyl group or an aryl group; and X is a methoxy group, an ethoxy group or a halogen atom.

R is preferably an alkyl group having from 4 to 8 carbon atoms in the formula 12. Examples of the preferable compound include trimethoxy-n-butylsilane, trimethoxy-i-butylsilane, trimethoxyhexylsilane and trimethoxyoctylsilane.

A hydrogenpolysiloxane compound is preferably used as the reactive organic silicon compound to be used in the last surface treatment. The hydrogenpolysiloxane having a molecular weight of from 1,000 to 20,000 is easily available and shows a suitable black spot inhibiting ability.

Particularly, good effect can be obtained when methylhydrogenpolysiloxane is used for the last surface treatment.

Another surface treatment for the titanium oxide is a treatment by an organic silicon compound having a fluorine atom. The treatment using the organic silicon compound having a fluorine atom is preferably applied by the following wet method.

The organic silicon compound having a fluorine atom is dissolved or suspended in an organic solvent or water and untreated titanium oxide particles are added therein. The liquid is mixed by stirring for a period of from several minutes to about 1 hour. Then the particles are filtered and dried. Thus the surface of each of the titanium oxide particles is covered by the organic silicon compound having a fluorine atom. In some cases, the mixture is heated before the filtration. The organic silicon compound having a fluorine atom may be added to the suspension comprising the organic solvent or water and the titanium oxide particles dispersed therein.

It is confirmed by a combination of surface analysis means such as electron spectroscopy for chemical analysis (ESCA), Auger electron spectroscopy, secondary ion mass spectroscopy and scatter reflection FI-IR that the surface of the titanium oxide particle is covered with the organic silicon compound having a fluorine atom.

Examples of the organic silicon compound having a fluorine atom include 3,3,4,4,5,5,6,6,6-nonafluorohexyltrichlorosilane, 3,3,3-trifluoropropyltrimethoxysilane, methyl-3,3,3-trifluoropropyldichlorosilane, dimethoxymethyl-3,3,3-trifluoropropylsilane and 3,3,4,4,5,5,6,6,6-nonafluorohexylmethyldichlorosilane.

The coating composition for forming the under coat layer contains the metal oxide particles such as the surface treated titanium oxide, binder resin and a dispersion medium.

The under coat layer is provided between the electroconductive substrate and the photosensitive layer and has functions of suitably adhering with the electroconductive substrate and the photosensitive layer, suitably transfer an electron injected from the photosensitive layer to the electroconductive substrate and preventing the positive hole injection from the substrate as a barrier.

The resin binder usable in the under coat layer includes a polyamide resin, a vinyl chloride resin, a vinyl acetate resin, a poly(vinyl acetal) resin, a poly(vinyl butyral) resin, a polyvinyl alcohol, a thermal hardenable resin such as a melamine resin, an epoxy resin and an alkyd resin, and a copolymer resin composed of two or more repeating units of the fore going resins. Among them, the polyamide resin is preferable and an alcohol-soluble polyamide such as an amide copolymer and a methoxymethylolized amide polymer is particularly preferable.

The amount of the surface-treated N-type semiconductive particle according to the invention to be dispersed in the binder is from 10 to 10,000 parts, preferably from 50 to 1,000 parts, by weight per 100 parts by weight of the binder resin in the case of the surface-treated titanium oxide. When the surface-treated titanium oxide is used in the foregoing amount, the dispersed status of the titanium oxide can be suitably maintained and a suitable under coat layer without the formation of black spot can be formed.

The thickness of the under coat layer is preferably from 0.5 to 15 μm for forming the under coat layer having a suitable electrophotographic property without the formation of black spot.

Photosensitive Layer

It is preferable that the photosensitive layer having a charge generation layer CGL and a charge transfer layer CTL separated from each other even though a single structure photosensitive layer having both of the charge generation function and the charge transfer function may be used. The increasing of the remaining potential accompanied with repetition of the use can be inhibited and another electrophotographic property can be suitably controlled by the separation the functions of the photosensitive layer into the charge generation and the charge transfer. In the photoreceptor to be negatively charged, it is preferable that the CGL is provided on a subbing layer and the CTL is further provided on the CGL. In the photoreceptor to be positively charged, the order of the CGL and CTL in the negatively charged photoreceptor is revered. The foregoing photoreceptor to be negatively charged having the function separated structure is most preferable.

Photoreceptor having the function separated structure is described.

Charge Generating Layer

A charge generating layer contains a charge generating material (CGM). In addition, the charge generating layer may contain a binder resin and other additives as necessary.

As charge generating materials of the organic photoreceptor of the invention, phthalocyanine pigments, azo pigments, perylene pigments, azulenium pigments can be used solely or in combination. Among these pigments, titanyl phthalocyanine pigments, gallium phthalocyanine pigments, perylene pigments are preferably employed. For example, titanyl phthalocyanine pigments having a maximum peak of Bragg angle 2θ±0.2° for CU—Kα radiation at 27.2°, benzimidazole perylene having a maximum peak of 2θ of the same at 12.4°, chlorogallium phthalocyanine pigments having diffraction peaks of Bragg angle (2θ±0.2°) for a diffraction spectrum of characteristic X ray of CU—Kα at least at positions of 7.4°, 16.6°, 25.5°, and 28.3° in, and hydroxygallium phthalocyanine pigments having diffraction peaks of Bragg angle (2θ±0.2°) for a diffraction spectrum of characteristic X ray of CU—Kα at least at positions of 7.5°, 9.9°, 12.5°, 16.3°, 18.6°, 25.1°, and 28.1°, have almost no variation in charging performance and sensitivity due to repeated use, and are preferably used accordingly.

In case of using a binder as a dispersion medium of a CGM in the charge generating layer, a known resin can be employed as the binder, and the most preferable resins are formal resin, butyral resin, silicone resin, silicone modified butyral resin, phenoxy resin. The ratio of the binder resin to the charge generating material is preferably 100 weight parts of binder resin to weight parts of charge generating material of from 20 to 600. Increase in residual electric potential with repeated use can be minimized by using these resins. The layer thickness of a charge generating layer is preferably 0.1 to 2 μm.

Charge Transport Layer

Charge transfer layer: the charge transfer layer contains a charge transfer material CTM and a layer-formable binder resin in which the CTM is dispersed. An additive such as an antioxidant may be further contained according to necessity.

For example, a triphenylamine derivative, a hydrazone compound, a styryl compound, a benzyl compound and a butadiene compound may be used as the charge transfer material CTM. These charge transfer material are usually dissolved in a suitable binder resin to form a layer. Among them, the charge transfer materials capable of minimizing the increasing of the remaining potential accompanied with repetition of use is one having a high electron mobility of not less than $10^{-5}$ $cm^2/V$ sec, and the difference of the ionization potential of such the CTM and that of the CGM to be used in combination with the CTM is preferably not more than 0.5 (eV), more preferably not more than 0.25 (eV).

The ionization potential of the CGM and CTM is measured by a surface analyzer AC-1, manufactured by Riken Keiki Co., Ltd.

Examples of the resin to be used for charge transfer layer CTL include a polystyrene, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicone resin, a melamine resin, a copolymer containing two or more kinds of the repeating unit contained the foregoing resins, and a high molecular weight organic semiconductive material such as poly(N-vinylcarbazole) other than the foregoing insulating resins.

The preferable example of the binder for CTL is polycarbonate resin, which results good dispersion ability of CTM and electrophotographic characteristics. It is preferable that the ratio of a binder resin to a charge transport material is set as 100 weight parts of binder resin to weight parts of charge transport material ranging from 10 to 200. The layer thickness of a charge transport layer is preferably 10 to 40 μm, mentioned above.

The substrate is prepared to have cylindricity of 5 to 40 mμ so that layers provided on the substrate are formed to have uniform thickness during coating or drying process, whereby deviation of thickness of whole layers including an under coat layer, a CGL, A CTL and so on is minimized, preferably to have 0.2 to 2 mμ. Example of method processing the substrate to have cylindricity precisely and dip coating apparatus by which uniform layer of the organic photoreceptor is prepared are described.

The term "cylindricity" is as defined in JIS B0621-1984 and represents a difference of radii between a geometrically correct cylinder inscribed in a cylindrical substrate coaxially therewith and a geometrically correct cylinder circumscribed about the cylindrical substrate coaxially therewith in case that the space between the two geometrically correct cylinders are minimum. The difference between radii is represented in the unit of μm.

The cylindricity of the cylindrical substrate is 5 to 40 μm, preferably 7 to 30 μm, and particularly preferably 7 to 27 μm ion view of minimized moiré generation and good yield.

The cylindricity is determined by measuring the roundness at each of the seven positions including a midpoint, two positions spaced a distance of 10 mm from opposite ends, and four intermediate positions determined by dividing a distance between the midpoint and each end into 3 divisions, using a non-contact universal roll diameter measuring device Laser Scan Micrometer (available from Mitsutoyo Corporation).

A process to obtain precise cylindricity is described by referring to drawings. The term centering process as used herein means cutting the inside of the cylindrical substrate to form a machined surface such as a step for the purpose of attaching a member. For example, while rotating the cylindrical substrate, a cutting bite is fed in the inside periphery of the cylindrical substrate and is fed in the axial direction to form a step.

The outside diameter reference means that the center axis of the outer cylindrical surface of the cylindrical substrate shall be the reference axis.

The inside diameter reference for the centering processed portion means that the center axis of the inside cylindrical surface formed by the centering process shall be the reference axis.

FIG. 1 is a schematically front view, illustrating an electrophotographic photoreceptor 10, which comprises a cylindrical substrate 11 and flanges 14, 15 provided at opposite ends 12, 13, respectively, of the cylindrical substrate 11. A photosensitive layer 16 is formed over an outer peripheral surface of the cylindrical substrate 11. The organic photoreceptor 10 has a centerline along which a shaft 17 is disposed in conformity with the axis C of the cylindrical substrate 11 so that the photoreceptor 10 is rotatable about the axis C.

The cylindrical substrate 11 is made of a conductive metal such as aluminum or an aluminum alloy and defines a hollow cylindrical space therein. The cylindrical substrate 11 of, for example aluminum alloy may be formed into a cylindrical shape by a drawing or a cutting process.

The flanges 14, 15, which are in the form of discs, are fitted into opposite end portions of the cylindrical substrate 11 and each provided with a bore 18 at the center thereof. One flange 14 has a geared periphery 14*a* for use in control of the rotation of the organic photoreceptor 10.

The bar like shaft 17 is preferably made of an undeformable material, such as, a metal or plastic, and has a rectangular (e.g. square), circular or cross-shaped cross section. The shaft 17 is passed through the bores 18 formed in the flanges 14, 15 and fixed for bearing the organic photoreceptor 10 for rotation.

The photosensitive layer 16 comprises a photoconductive material exhibiting a photoelectric effect and may be, for example, a layer of an organic photoconductor (OPC).

The cylindrical substrate 11 is processed to have a cylindricity of 5 to 40 μm.

Figure 2:
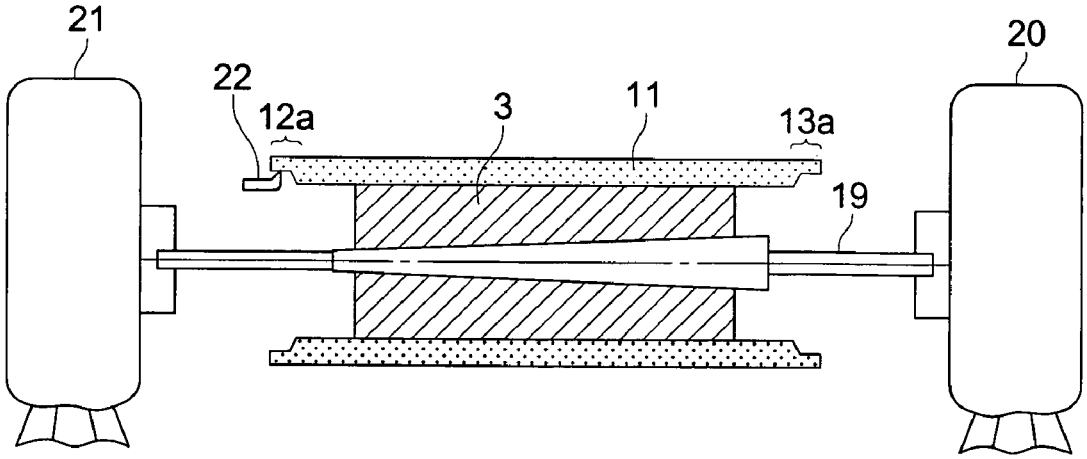
FIGS. 2(*a*) and 2(*b*) show the one embodiments of manufacturing processes of a cylindrical substrate in order.
Figure 2:
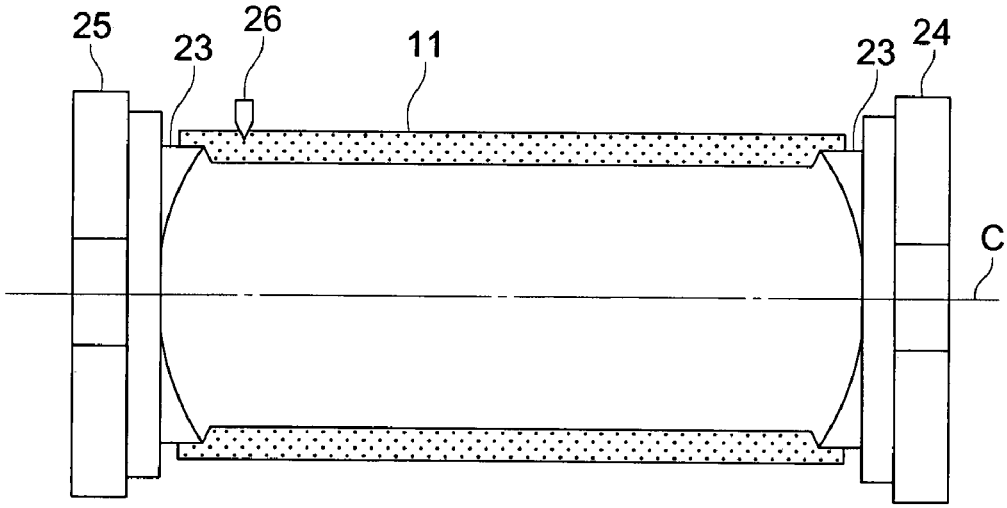

FIGS. 2A and 2(*b*) illustrates the manufacturing processes of a cylindrical substrate in order. First, a cylindrical substrate 11 as shown in FIG. 2A is provided. The cylindrical substrate 11 may be, for example, an aluminum alloy cylinder having an outer diameter of 100 mm and a wall thickness of 2 mm which is formed by a drawing process.

FIG. 2(*a*) shows a process in which a supporting member 3 is inserted into the cylindrical substrate 11 and is being cutting with a bite 22 for the centering process. At each inside wall of the opposite end portions, a step is given by the centering process, thereby forming thin wall portions (centering processed portion) 12*a*, 13*a* having the same outside diameter as they were, while the thickness is made smaller by the thickness of the step, that is, the inside diameter becomes larger.

The supporting member is intended to refer to a member inserted to press fit into the internal wall of the cylindrical substrate, thereby preventing the vibration and deformation of the cylindrical substrate while the cylindrical substrate is machined, such as the centering process.

Steps having a length of d mm the thin wall portion in the axial direction of the cylindrical substrate are formed at both ends of the cylindrical substrate, since the centering process is mainly for the purpose of forming a step in each of the opposite end portions of the cylindrical substrate for fitting flanges in respective steps. The axial length D(mm) of the supporting member is preferably within the following range:

$$\tfrac{1}{2}\times L \leqq D < (L-2d)$$

wherein L is the length (mm) of the cylindrical substrate (axial direction). When the length D is not more ½ times of L, the both ends of the cylindrical substrate are stable so that accuracy in machining is maintained. When D is (L−2d) or less, a sufficient space for the centering process is feasible so that it makes easy to perform the centering process.

According to the invention, in the centering process, while the cylindrical substrate is supported from inside by the supporting member 3 and the pressure controlling section 4, the cylindrical substrate is rotated about the center shaft 19 which extends through the supporting member by the motors 20, 21. A cutting bite 22 is displaced while contacting with the inside of the cylindrical substrate, thereby performing the centering process. Because the cylindrical substrate is supported from inside during the centering process, there is no fear of injures of the outer surface of the cylindrical substrate.

The cylindrical substrate having subjected to the centering process is then subjected to machining to cut the outer peripheral surface thereof. In FIG. 2(*b*), the cylindrical substrate is held at thin wall portion at both ands thereof by a pair of releasable holding pawls 23 of a non-sliding chucks 24, 25 (e.g. AIR BALLOON CHUCKS or KRAFTGRAPHY manufactured by Fujii Seimitsukogyo Co, Ltd; DIAPHRAGM CHUCKS manufactured by Dynamic Tool Co., Ltd.) and the peripheral outer surface of the cylindrical substrate 11 is machined with the inside diameter reference.

By adapting the above process method for the cylindrical substrate, the cylindrical substrate 11 for the electrophotographic photoreceptor having a cylindricity of 5 to 40 μm can be prepared. Reference numeral 26 denotes a cutting bite.

The supporting member is preferably made of a high strength and high rigidity material, such as a metal (e.g. stainless steel or brass) or a ceramic for reasons of prevention of vibration and deformation of the cylindrical substrate during the centering process. It is also preferred that the supporting member be provided with sections for controlling the contact pressure. A method of inserting and pressing the rigid member against the inside surface of the cylindrical substrate will be described below.

FIG. 3(*a*) is a perspective view of the supporting member 3. FIG. 3(*b*) is a sectional view of the pressure variable section 4 of the supporting member. In this instance, the supporting member 3 is composed of sections 3-1 to 3-8 each of which has a sector-shaped cross-section and which are interconnected to each other by resilient members such as springs (not shown). The outside periphery of the supporting member 3 is cylindrical so as to contact the inside cylindrical periphery of the cylindrical substrate. At the central portion of the supporting member, as shown in FIG. 3(*b*), there is formed a central bore for putting in and out a center rod 41 having a taper. As shown in FIG. 3(*b*), insertion of the center rod 41 forces the supporting member to expand outwardly and thus the cylindrical substrate is held while it is pressed. The contact pressure upon pressing can be controlled depending on the axial displacement of the center rod 4-1.

Alternatively, the supporting member 3 may be formed of a resilient material such as a hard urethane resin or a rubber.

The center rod 4-1 has a center axis 19 passing through the supporting member, about which the cylindrical substrate is rotated for centering process.

Figure 4:
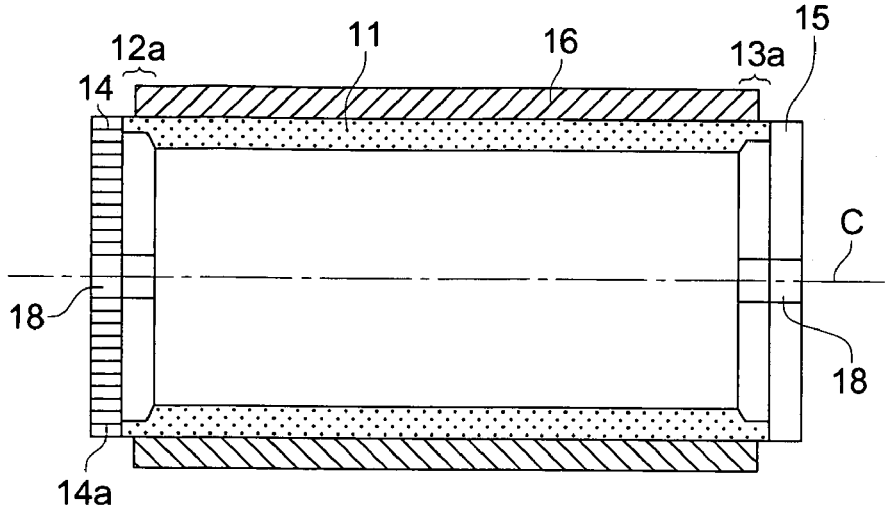
FIG. 4 is a sectional view of one example of a cylindrical substrate, an outer surface of which a photosensitive layer is applied.

The outer surface of the substrate 11 is then washed and applied with a photosensitive coating to form the photosensitive layer 16 as shown in FIG. 4.

Thereafter, the flanges 14, 15 are attached to the substrate 11 having a photosensitive layer coated. Each of the flanges 14, 15 is in the form of a disk having an outer section serving as a lid and having an outer diameter nearly equal to that of the cylindrical substrate 11, and an inner section having an outside diameter smaller than that of the outside section. At the center of the disk, a bore 28 is formed. The outside diameter of the inner section is equal to or slightly larger than the inside diameter of the thin wall portions 12*a* 13*a*. Thus, the flanges 14, 15 can be fixedly secured to the substrate 11 with the smaller diameter sections being tightly fitted into the thin wall portions 12*a*, 13*a*. The flanges 14, 15 are thus secured to the respective ends of the cylindrical substrate 11 in a lid like manner. The photoreceptor preferably has a cylindricity of 5 to 40 μm with a center of a shaft C of the cylindrical substrate 11, in the state of the flanges 14, 15 being attached. The flange 14 has a gear 14*a* on a periphery portion. There is formed a bore 18 for fixing the shaft at the central portion of each flange.

Dip coat method, which minimizes deviation of coat thickness, is described.

Figure 5:
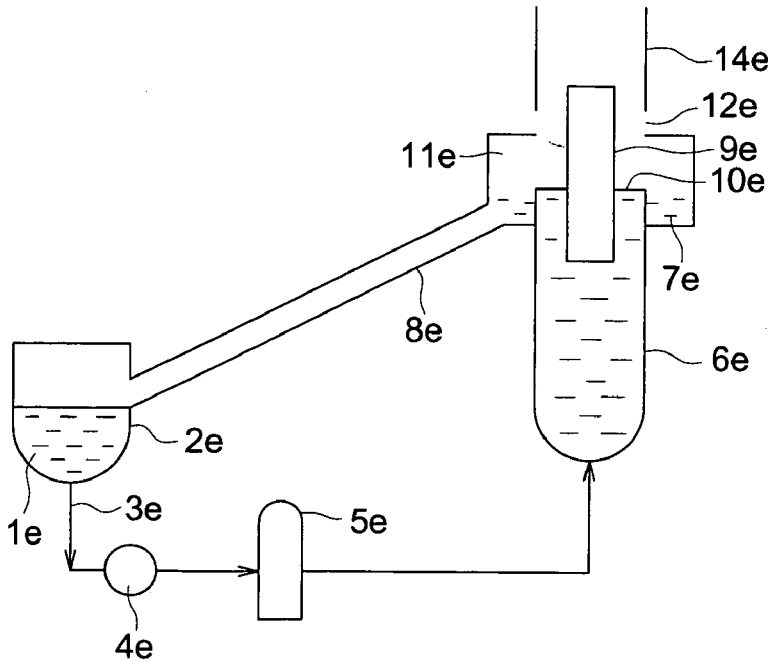
FIG. 5 is a system block diagram of a single-cylinder dip-coating apparatus.

FIG. 5 is a system block diagram of a single-cylinder dip-coating apparatus. In this figure, the cylindrical substrate 9*e* is dipped in the coating liquid bath 6*e*, coated there, and now being pulled up from the coating liquid. When pulled up from the coating liquid bath, the cylindrical substrate enter the solvent vapor chamber 11*e* to let the layer covering the substrate on the substrate emit a lot of solvent vapor, and then enter the drying hood 14*e* to be dried up until the coat is not sticky to your fingers. The present invention provides an exhaust port 12*e* between said solvent vapor chamber and the drying hood. This exhaust port can exhaust a lot of solvent vapor while keeping the concentration of solvent vapor uniform in the whole solvent vapor chamber even when a solvent of high saturated vapor pressure is used for the coating liquid or when a coat of 50 μm or thicker evaporating a lot of solvent vapor is formed. This hole is effective to suppress drying unevenness of coats and increase of the leading thin coat area.

A solvent vapor chamber is a room provided to cover a layer covering the substrate so that solvent vapor from coating composition or layer covering the substrate is damped so as to maintain uniform solvent vapor density circumstance. The drying hood preferably has height of 1 to 100 cm to stabilize the film on the cylindrical substrate immediately after coating.

The exhaust port is provided between the solvent vapor chamber and the drying hood to surround a cylindrical substrate which is being pulled up after coating. In other words, it is preferred that said exhaust port 12 is provided between the solvent vapor chamber and the drying hood with a clearance of 0.1 to 10 mm between them. If the clearance is less than 0.1 mm, the solvent vapor is not exhausted sufficiently. If the clearance is more than 10 mm, the solvent vapor in the chamber is exhausted sufficiently but apt to be disturbed by air coming from the outside and the concentration of the solvent vapor in the chamber is apt to be non-uniform.

The ceiling of said solvent vapor chamber has an opening (through-hole) to let a cylindrical substrate pass through it. The opening is preferably circular as well as the cylindrical substrate.

The preferred length of the drying hood is 5 to 300 cm. If the length is shorter than 5 cm, the drying hood has little effect to eliminate uneven coat thicknesses. If the length is longer than 300 cm, the effect of the drying hood does not offset the large dimensions of the apparatus.

It is preferred that said solvent vapor chamber is equipped with a recycle tube to keep the liquid level of the coating liquid bath constant. FIG. 5 shows a preferred configuration of said solvent vapor chamber with a recycle tube. The coating liquid 1 is transferred by force by the pump 4*e* from the coating liquid tank 2*e* to the coating liquid bath 6*e* through the supply pipe 3*e* and the filter 5*e*. The coating liquid supplied into the coating liquid bath 6*e* overflows down to the coating liquid conduit 7*e* which is continuously provided on the lower part of the solvent vapor chamber 11*e*, runs into the recycle tube 8*e*, and goes back to the coating liquid tank 2*e*. This liquid circulating means transfers the coating liquid in loop during dip-coating to keep the level 10*e* of the coating liquid in the coating liquid bath constant irrespectively of whether the cylindrical substrate are dipped in the bath or pulled up from the bath. Further, an exhaust port 12*e* to exhaust solvent vapor is provided above the solvent vapor chamber and higher than the liquid level of the coating liquid bath. A drying hood 14*e* is provided above the solvent vapor chamber 11*e* to prevent the solvent vapor from being disturbed by air coming from the outside.

Without the exhaust port 12*e* or when the exhaust port 12*e* is provided in the recycle tube 8*e* below the coating liquid level 10 (as described in JP A 08-220786), the solvent vapor cannot be exhausted fully from the solvent vapor chamber 11 and remains stagnant in the drying hood in case a solvent of high saturated vapor pressure such as methylene chloride is used or in case a coat of 50 μm or thicker evaporating a lot of solvent vapor is formed. As the result, this causes coat dry-up unevenness and increases the leading thin coat area. However, the present invention provides the exhaust port 12*e* above the solvent vapor chamber and higher than the coating liquid level 10*e*. Therefore, even when a solvent of high saturated vapor pressure is used, the solvent vapor can be exhausted uniformly from around the cylindrical substrate. This port is effective to suppress drying unevenness of coats and increase of the leading thin coat area.

Examples of the solvent or the dispersing medium to be used for preparing the interlayer, the photosensitive layer and another layer include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,1,2-trichloroethane, 1,1,1-trichloroethane, trichloroethylene, tetrachloroethane, tetrahydrfurane, dioxorane, dioxane, methanol, ethanol, butanol, iso-propanol, ethyl acetate, butyl acetate, dimethylsulfoxide and methyl cellosolve.

The solvent for the interlayer coating composition is not limited thereto. Among them, methanol, ethanol, 1-propanol and iso-propanol are preferably used. The solvents may be used singly or in combination.

The photoreceptor of the present invention can form an electrophotographic image having a high gradation and high sharpness by employing toner having a sharp particle size distribution in combination.

Toner employed in this invention is described. A volume particle diameter, a number particle diameter, ratio thereof and so on are described.

(1) A toner having a number ratio of toner particles having a shape coefficient of 1.2 to 1.6 at least 65%.

The toner having a number ratio of toner particles having a shape coefficient of 1.2 to 1.6 has moderate affinity to the photoreceptor to minimize cleaning trouble. The toner containing such toner particles having a shape coefficient of preferably 1.2 to 1.6 at least 65%, more preferably 70% is employed in combination of the photoreceptor of the present invention, whereby good image forming with good cleaning characteristics is obtained.

(2) A toner having a number ratio of toner particles having no corners is at least 50%

The toner particles having no corners is a particle having no projection to which charges are concentrated or which tend to be worn down by stress. The number ratio of toner particles having no corners is preferably at least 50%, and or more preferably at least 70%.

(3) A toner in which the sum M of the relative frequency $m_1$ of the toner particle included in the class containing largest number of the particles and the relative frequency $m_2$ of the toner particles included in the class containing secondary number of the particles is not less than 70% in a histogram representing the particle size distribution based on the number, in the histogram, the natural logarithm lnD of the diameter of toner particle D in μm is measured on the horizontal axis and the horizontal axis is divided every 0.23.

By adjusting the sum (M) of the relative frequency ($m_1$) and the relative frequency ($m_2$) to at least 70%, the dispersion of the resultant toner particle size distribution narrows. Thus, it is possible to form a toner image stably and further, by employing said toner in an image forming process in combination of the photoreceptor of the present invention, it is possible to form a toner image with good cleaning characteristics and good image forming for long period of time.

(4) A toner containing toner particles having variation coefficient of the shape coefficient of not more than 16% and number variation coefficient of number distribution of particle diameter of not more than 27%.

A toner containing toner particles having variation coefficient of the shape coefficient of not more than 16% and number variation coefficient of number distribution of particle diameter of 27% is preferably used in combination of the photoreceptor of the present invetion whereby it is possible to form a toner image with good cleaning characteristics, good fine lines reproduction and good image forming for long period of time.

The variation coefficient of number distribution of particle diameter is preferably not more than 27% and more preferably not more than 25%. The variation coefficient of the shape coefficient is preferably not more than 16% and more preferably not more than 14%.

It is preferable that the toner particles has a number ratio of toner particles having a shape coefficient of 1.2 to 1.6 at least 65% as well as variation coefficient of the shape coefficient of not more than 16%. Such toner has not excess affinity to the photoreceptor and shows good cleaning characteristics.

It is possible to form a toner image with good cleaning characteristics, good fine lines reproduction and good image forming for long period of time by employing the toner having a number ratio of toner particles having no corners being at least 50% and number variation coefficient of number diameter distribution The toner having number average primary particle diameter of 3 to 8 μm is preferably employed. The particle diameter can be obtained by controlled by, amount of coagulant or organic solvent to add, fusing period, composition of polymer and so on, in case of polymerization toner particle preparation method.

It is possible to form a toner image with stable development condition for long time, good half tone image and reproduction of fine lines or dot image by obtaining high toner transfer efficiency by employing the toner having number average primary particle diameter of 3 to 8 μm.

Preferable particle size distribution of toner particles is one which is obtained when particles are monodispersed or nearly monodispersed. It is preferable that ratio (Dv50/Dp50) is from 1.0 to 1.15, wherein (Dv50) is the 50% volume particle diameter and (Dp50) is the 50% number particle diameter. The ratio is more preferably from 1.00 to 1.13.

Further, ratio (Dv75/Dp75) is from 1.00 to 1.12, wherein Dv75 is the cumulative 75% volume particle diameter from the maximum diameter of the toner particle and Dp75 is the cumulative 75% number particle diameter for the purpose of inhibiting fluctuation of development or transfer performance.

Further, the proportion of colored particles, having a particle diameter of at most 0.7×(Dp50), is less than or equal to 10% by number and more preferably 5 to 9% by number.

The 50% volume particle diameter (Dv50) is preferably from 2 to 8 μm, and is more preferably from 3 to 7 μm. The 50% number particle diameter (Dp50) is preferably from 2 to 7.5 μm, and is more preferably from 2.5 to 7 μm.

The cumulative 75% volume particle diameter (Dv75) or the cumulative 75 number particle diameter from the largest particle, as described herein, refers to the volume particle diameter or the number particle diameter at the position of the particle size distribution which shows 75% of the cumulative frequency with respect to the sum of the volume or the sum of the number from the largest particle.

It is possible to determine 50% volume particle diameter (Dv50), 50% number particle diameter (Dp50), cumulative 75% volume particle diameter (Dv75), and cumulative 75% number particle diameter (Dp75), employing a Coulter Counter Type TAII or a Coulter Multisizer (both are manufactured by Coulter Inc.).

The shape coefficient of the toner particles is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

The shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient of the present invention was obtained employing the aforementioned calculation formula.

The number ratio of toner particles in the range of said shape coefficient of 1.2 to 1.6 is preferably at least 65% and is more preferably at least 70%.

Methods to control said shape coefficient are not particularly limited. For example, a method may be employed wherein a toner is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current. It is preferable to employ a polymerization method having preferable shape coefficient.

The variation coefficient of the polymerized toner, which is preferably employed in the present invention, is calculated using the formula described below:

$$\text{Variation coefficient}=(S/K)\times 100\ (\text{in }\%)$$

wherein S represents the standard deviation of the shape coefficient of 100 toner particles and K represents the average of said shape coefficient.

Said variation coefficient of the shape coefficient is generally not more than 16%, and is preferably not more than 14%. By adjusting said variation coefficient of the shape coefficient to not more than 16%, voids in the transferred toner layer decrease to improve fixability and to minimize the formation of offsetting. Further, the resultant charge amount-distribution narrows to improve image quality.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles.

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by To a Medical Electronics Inc.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 μm aperture. The volume and the number of particles having a diameter of at least 2 μm were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100 \text{ (in \%)}$$

wherein S represents the standard deviation in the number particle size distribution and $D_n$ represents the number average particle diameter (in μm).

Methods to control the number variation coefficient are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27%, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

Figure 9:
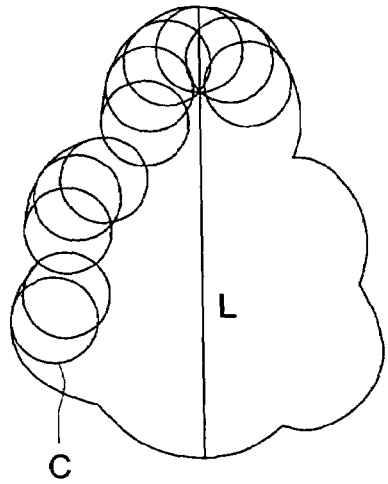
FIG. 9(*a*) is a schematic view showing toner particle having no corner.
Figure 9:
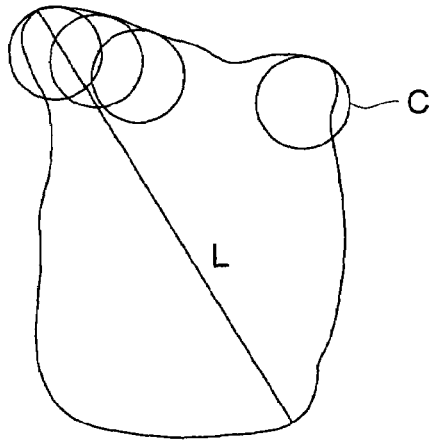
Figure 9:
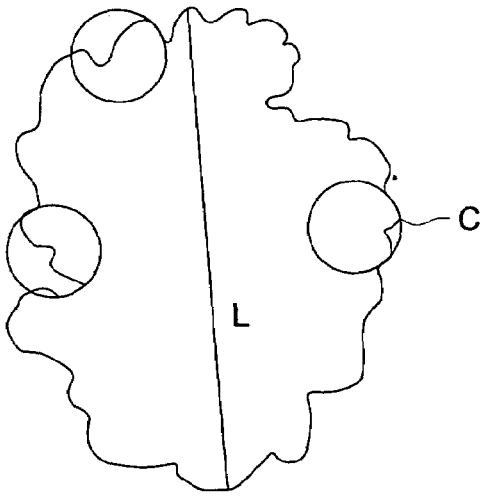

The toner particles, which substantially have no corners, as described herein, mean those having no projection to which charges are concentrated or which tend to be worn down by stress. Namely, as shown in FIG. 9(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 9(*b*) and 9(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current. It is preferable to employ a polymerization method having preferable shape coefficient in view of production cost, energy cost and so on.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

The diameter of the toner particles is preferably between 3 and 8 μm in terms of the number average particle diameter. When toner particles are formed employing a polymerization method, it is possible to control said particle diameter utilizing the concentration of coagulants, the added amount of organic solvents, the fusion time, or further the composition of the polymer itself.

Preferable particle size distribution of toner particles is one which is obtained when particles are monodispersed or nearly monodispersed. It is essential that ratio (Dv50/Dp50) is from 1.00 to 1.15, wherein (Dv50) is the 50% volume particle diameter and (Dp50) is the 50% number particle diameter. The ratio is more preferably from 1.00 to 1.13.

Further, ratio (Dv75/Dp75) is preferably from 1.00 to 1.20 and more preferably 1.1 to 1.19, wherein Dv75 is the cumulative 75% volume particle diameter from the maximum diameter of the toner particle and Dp75 is the cumulative 75% number particle diameter for the purpose of inhibiting fluctuation of development or transfer performance.

Further, the proportion of colored particles, having a particle diameter of at most 0.7 times of (Dp50), is less than or equal to 10% by number and more preferably 5 to 9% by number.

The 50% volume particle diameter (Dv50) is preferably from 2 to 8 μm, and is more preferably from 3 to 7 μm. The 50% number particle diameter (Dp50) is preferably from 2 to 7.5 μm, and is more preferably from 2.5 to 7 μm.

The cumulative 75% volume particle diameter (Dv75) or the cumulative 75 number particle diameter from the largest particle, as described herein, refers to the volume particle diameter or the number particle diameter at the position of the particle size distribution which shows 75% of the cumulative frequency with respect to the sum of the volume or the sum of the number from the largest particle.

It is possible to determine 50% volume particle diameter (Dv50), 50% number particle diameter (Dp50), cumulative 75% volume particle diameter (Dv75), and cumulative 75% number particle diameter (Dp75), employing a Coulter Counter Type TAII or a Coulter Multisizer (both are manufactured by Coulter Inc.).

In a histogram which shows the number based particle size distribution in which natural logarithm lnD, wherein D (μm) represents the diameter of toner particles, is taken as the abscissa which is divided into a plurality of classes at an interval of 0.23, toner is preferred in which the sum (M) of the relative frequency (m1) of toner particles included in the most frequent class and the relative frequency (m2) of toner particles included in the second most frequent class is at least 70%.

When the sum (M) of the relative frequency (m1) and the relative frequency (m2) is controlled to be at least 70%, the particle size distribution of toner particles is narrowed. As a result, by employing the aforesaid toner in the image forming process, it is possible to assuredly retard the generation of selective development.

In the present invention, the aforesaid histogram which shows the number based particle size distribution, is prepared in such a manner that natural logarithm lnD (wherein D represents the diameter of each toner particle) is divided at a interval of 0.23 into a plurality of classes (0-0.23:0.23-0.46:0.46-0.69:0.69-0.92:0.92-1.15:1.15-1.38:1.38-1.61:1.61-1.84:1.84-2.07:2.07-2.30:2.30-2.53:2.53-2.76 . . . .

This histogram was prepared as follows. Particle diameter data determined by a Coulter Multisizer under the conditions described below are transferred to a computer via an I/O unit and analyzed employing the particle size distribution analysis program installed in the aforesaid computer.

<<Measurement Conditions>>

(1) Aperture: 100 μm (2) Sample preparation method: While stirring, a suitable amount of a surface active agent (a neutral detergent) is added to 50-100 ml of an electrolyte (ISOTON R-11, manufactured by Coulter Scientific Japan Co.) and 10-20 mg of a sample to be measured is added to the resulting mixture. Subsequently, the resulting mixture is dispersed for one minute, employing an ultrasonic homogenizer.

Components of toner and its preparation method are described.

The toner employed in this invention comprises a colorant and a binder resin. The toner may be prepared by a method in which comprises pulverization and a classification, or so called polymerization method in which resin particles obtained by polymerization are employed for toner preparation. Particularly preferable method is that includes a process of salting out/fusing resin particles in the polymerization method.

Various raw materials such as a colorant, a mold releasing agent according to necessity, a charge controlling agent and a polymerization initiator are added into a polymerizable monomer and dispersed or dissolved by a homogenizer, a sand mill, a sand grinder or a ultrasonic dispersing apparatus. The polymerizable monomer in which the raw materials are dissolved or dispersed is dispersed into a form of oil drops having a suitable size as toner particle by a homomixer or a homogenizer in an aqueous medium containing a dispersion stabilizing agent. Then the dispersion is moved into a reaction vessel having a stirring device with double stirring blades, and the polymerization reaction is progressed by heating. After finish of the reaction, the dispersion stabilizing agent is removed from the polymer particles and the polymer particles are filtered, washed and dried to prepare a toner.

The toner according to the invention can be also obtained by salting-out/fusing resinous particles prepared in an aqueous medium.

For example, the methods described in JP O.P.I. Nos. 5-265252, 6-329947 and 9-15904 are applicable. The toner can be produced by a method by which dispersed particles of constituting material such as resinous particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, an infinitely water-miscible solvent such as alcohol may be added together with the coagulation agent.

A radical polymerizable monomer is used as a component and a cross-lining agent can be used. It is preferable to use at least one of the radical polymerizable monomer having an acid group or a base group.

(1) Radical Polymerizable Monomers

Radical polymerizable monomers are not particularly limited. It is possible to employ conventional radical polymerizable monomers known in the art. Further, they may be employed in combination of two or more types so as to satisfy desired properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Agents

In order to improve the desired properties of toner, added as crosslinking agents may be radical polymerizable crosslinking agents. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Radical Polymerizable Monomers Having an Acidic Group or a Basic Group

Employed as radical polymerizable monomers having an acidic group or a basic group may, for example, be amine based compounds such as monomers having a carboxyl group, monomers having a sulfonic acid group, and amine based compounds such as primary, secondary, and tertiary amines, quaternary ammonium salts, and the like.

Listed as radical polymerizable monomers having an acidic group are acrylic acid, methacrylic acid, fumaric acid, maleic acid, itaconic acid, cinnamic acid, monobutyl maleate, monooctyl maleate, and the like as monomers having a carboxyl group.

Listed as monomers having sulfonic acid are styrenesulfonic acid, allylsulfosuccinic acid, octyl allylsulfosuccinate, and the like.

These may be in the form of salts of alkali metals such as sodium or potassium, or salts of alkali earth metals such as calcium and the like.

Listed as radical polymerizable monomers having a basic group are amine based compounds which include dimethyl aminoethyl acrylate, dimethyl aminoethyl methacrylate, diethyl aminoethyl acrylate, diethyl aminoethyl methacrylate, and quaternary ammonium salts of said four compounds; 3-dimethylaminophenyl acrylate, 2-hydroxy-3-methacryloxypropyltrimethylammonium salt; acrylamide, N-butylacrylamide, N,N-dibutylacrylamide, piperidylacrylamide, methacrylamide, N-butylmethacrylamide, N-octadecylacrylamide; vinylpyridine; vinylpyrrolidone; vinyl N-methylpyridinium chloride, vinyl N-ethylpyridinium chloride, N,N-diallylmethylammonium chloride, N,N-diallylethylammonium chloride; and the like.

The content ratio of radical polymerizable monomers having an acidic group or a basic group is preferably 0.1 to 15% by weight with respect to the total monomers. The content ratio of radical polymerizable crosslinking agents is preferably 0.1 to 10% by weight with respect to the total radical polymerizable monomers.

(Chain Transfer Agents)

For the purpose of regulating the molecular weight of resinous particles, it is possible to employ commonly used chain transfer agents. Said chain transfer agents are not particularly limited, and for example, employed are mercaptans such as octylmercaptan, dodecylmercaptan, tert-dodecylmercaptan, and the like, carbon tetrabromide, styrene dimer, and the like.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (ascorbic acid and the like), which is capable of initiating the polymerization at room temperature, it is possible to carry out polymerization at room temperature or higher.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, nonionic surface active agents may be employed. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

These are employed as an emulsifier during the emulsion polymerization process, and further are employed for other purposes or in other processes.

<Colorants>

Listed as colorants which constitute the toner of the present invention may be inorganic pigments, organic pigments, and dyes.

Practical inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20% by weight with respect to the polymer, and is preferably between 3 and 15% by weight.

When employed as a magnetic toner, it is possible to add said magnetite. In that case, from the viewpoint of providing specified magnetic properties, said magnetite is incorporated into said toner preferably in an amount of 20 to 60% by weight.

The organic pigments and dyes may be employed. Practical organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

These organic pigments, as well as dyes, may be employed individually or in combination of selected ones, if desired. Further, the added amount of pigments is commonly between 2 and 20% by weight, and is preferably between 3 and 15% by weight.

The colorants may also be employed while subjected to surface modification. As said surface modifying agents may be those conventionally known in the art, and specifically, preferably employed may be silane coupling agents, titanium coupling agents, aluminum coupling agents, and the like.

Toner employed in the invention may contain a releasing agent. Preferable examples of the releasing agent include low molecular weight polyolefin wax such as polypropylene and polyethylene, and paraffin wax, Fischer-Tropsch wax, and ester wax. A particularly preferable example is an ester compounds represented by General Formula (3), described below.

$$R^1—(OCO—R^2)_n \qquad \text{Formula (3)}$$

wherein n represents an integer of 1 to 4, and preferably 2 to 4, more preferably 3 or 4, and in particular preferably 4.

$R^1$ and $R^2$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 13 to 29, more preferably 12 to 25.

The representative examples are listed.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

-continued

10)

$$\begin{array}{l} CH_2-O-CO-(CH_2)_{26}-CH_3 \\ | \\ CH-O-CO-(CH_2)_{26}-CH_3 \\ | \\ CH_2-O-CO-(CH_2)_{26}-CH_3 \end{array}$$

11)

$$\begin{array}{l} CH_2-O-CO-(CH_2)_{22}-CH_3 \\ | \\ CH-O-CO-(CH_2)_{22}-CH_3 \\ | \\ CH_2-O-CO-(CH_2)_{22}-CH_3 \end{array}$$

12)

$$\begin{array}{l} CH_2-OH \\ | \\ CH-O-CO-(CH_2)_{26}-CH_3 \\ | \\ CH_2-O-CO-(CH_2)_{26}-CH_3 \end{array}$$

13)

$$\begin{array}{l} CH_2-OH \\ | \\ CH-O-CO-(CH_2)_{22}-CH_3 \\ | \\ CH_2-O-CO-(CH_2)_{22}-CH_3 \end{array}$$

14)

$$\begin{array}{l} CH_2-OH \\ | \\ CH-OH \\ | \\ CH_2-O-CO-(CH_2)_{26}-CH_3 \end{array}$$

15)

$$\begin{array}{l} CH_2-OH \\ | \\ CH-OH \\ | \\ CH_2-O-CO-(CH_2)_{22}-CH_3 \end{array}$$

16)

$$CH_3-(CH_2)_{26}-COO-CH_2-\overset{\overset{CH_3}{|}}{\underset{\underset{CH_2-O-CO-(CH_2)_{26}-CH_3}{|}}{C}}-CH_2-O-CO-(CH_2)_{26}-CH_3$$

17)

$$CH_3-(CH_2)_{20}-COO-CH_2-\overset{\overset{CH_2CH_3}{|}}{\underset{\underset{CH_2-O-CO-(CH_2)_{20}-CH_3}{|}}{C}}-CH_2-O-CO-(CH_2)_{20}-CH_3$$

18)

$$CH_3-(CH_2)_{26}-COO-CH_2-\overset{\overset{CH_2-O-CO-(CH_2)_{26}-CH_3}{|}}{\underset{\underset{CH_2-O-CO-(CH_2)_{26}-CH_3}{|}}{C}}-CH_2-O-CO-(CH_2)_{26}-CH_3$$

19)

$$CH_3-(CH_2)_{20}-COO-CH_2-\overset{\overset{CH_2-O-CO-(CH_2)_{20}-CH_3}{|}}{\underset{\underset{CH_2-O-CO-(CH_2)_{20}-CH_3}{|}}{C}}-CH_2-O-CO-(CH_2)_{20}-CH_3$$

20)

$$CH_3-(CH_2)_{18}-COO-CH_2-\overset{\overset{CH_2-O-CO-(CH_2)_{18}-CH_3}{|}}{\underset{\underset{CH_2-O-CO-(CH_2)_{18}-CH_3}{|}}{C}}-CH_2-O-CO-(CH_2)_{18}-CH_3$$

21)

$$CH_3-(CH_2)_{16}-COO-CH_2-\overset{\overset{CH_2-O-CO-(CH_2)_{16}-CH_3}{|}}{\underset{\underset{CH_2-O-CO-(CH_2)_{16}-CH_3}{|}}{C}}-CH_2-O-CO-(CH_2)_{16}-CH_3$$

-continued

22)

$$CH_3-(CH_2)_{20}-COO-CH_2-\overset{\overset{CH_2-O-CO-CH_3}{|}}{\underset{\underset{CH_2-O-CO-CH_3}{|}}{C}}-CH_2-O-CO-CH_3$$

The ester wax is incorporated in resin particles and gives the toner obtained by fusing the resin particles suitable fixing ability.

The releasing agent is added in an amount of between 2 and 20% by weight, and is preferably between 3 and 15% by weight. The toner used in this invention is preferably prepared by the following process. The releasing agent dissolved in polymerizable monomer is dispersed in water, and they are subjected to polymerization reaction to prepare resin particles containing the releasing agent. The toner is prepared by salting out/fusing the resin particles and colorant particles.

Besides colorants and releasing agents, materials, which provide various functions as toner materials may be incorporated into the toner of the present invention. Specifically, charge control agents are cited. Said agents may be added employing various methods such as one in which during the salting-out/fusion stage, said charge control agents are simultaneously added to resinous particles as well as colorant particles so as to be incorporated into the toner, another is one in which said charge control agents are added to resinous particles, and the like.

In the same manner, it is possible to employ various charge control agents, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

<External Additives>

For the purpose of improving fluidity as well as chargeability, and of enhancing cleaning properties, the toner of the present invention may be employed into which so-called external additives are incorporated. Said external additives are not particularly limited, and various types of fine inorganic particles, fine organic particles, and lubricants may be employed.

Minute inorganic particles may be employed. Specifically, it is possible to preferably employ fine silica, titanium, and alumina particles and the like. These fine inorganic particles are preferably hydrophobic. Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by TAYCA CORPORATION; commercially available TA-300SI, TA-500, TAF-130, TAF-510, and TAF-510T, produced by Fuji Titanium Industry Co. Ltd.; commercially available IT-S, IT-OA, IT-OB, and IT-OC, produced by Idemitsu Kosan Co. Ltd.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5% by weight with respect to the toner. The external additives are added by employing a mixing machine such as a tubular mixer, Henschel mixer, Nauter mixer V-type mixer.

The production method of the toner for developing the static latent image is described below.

Production Process

The toner is preferably produced by a polymerization process comprising the steps of dispersing the aforesaid polymerizable monomer or a solution of the polymerizable monomer in which a mold releasing agent is dissolved into an aqueous medium, preparing resin particles including a mold releasing agent by polymerization, aggregating the resin particles by fusion in the aqueous medium, separation by filtrating and washing the resultant particles to remove the surfactant, drying the resultant particles, and adding an exterior additive to the dried particles. Thus obtained resin particles may be colored particles or uncolored particles. In the later case, colored particles can be prepared by adding colored particles to the dispersion of the resin particles and adhesion by fusion to the resin particle in the aqueous medium.

For adhesion by fusion, a method is preferred in which the resin particles formed by polymerization are subjected to salting-out/adhesion by fusion. When uncolored resin particles are used, the colored particles can be salted-out/adhered by fusion with the resin particles in the aqueous medium.

Charge control agent or other agent in addition to the colorant and releasing agent may also be added at this stage in particle form.

"Water based medium", as described in said salting-out/fusion process, refers to one in which water is a main component (at least 50% by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare colorant particles employed in said salting-out/fusion process by dispersing colorants into a water based medium. Dispersion of colorants is carried out in such a state that the concentration of surface active agents in water is adjusted to at least critical micelle concentration. An oil soluble polymerization initiator can be added in the monomer composition.

Homogenizers to disperse oil are not particularly limited, and preferably listed are "Clearmix", ultrasonic homogenizers, mechanical homogenizers, Manton-Gaulin and pressure type homogenizers.

Further, colorants may be subjected to surface modification. The surface modification method is as follows. Colorants are dispersed into a solvent, and surface modifiers are added to the resulting dispersion. Subsequently the resulting mixture is heated so as to undergo reaction. After completing said reaction, colorants are collected by filtration and repeatedly washed with the same solvent. Subsequently, the washed colorants are dried to obtain the colorants (pigments) which are treated with said surface modifiers.

Colored particles may be prepared by a method in which a colorant is dispersed in water based medium. The colorant is dispersed preferably in water containing a surfactant having not less than critical micelle concentration (CMC).

Homogenizers to disperse colorants are not particularly limited, and preferably listed are "Clearmix", ultrasonic homogenizers, mechanical homogenizers, Manton-Gaulin and pressure type homogenizers, and medium type homogenizers such as sand grinders, Getzman mill, diamond fine mills and the like. Further, listed as surface active agents may be the same as those previously described.

Surfactants can be employed in this process.

The salting-out/fusion process is accomplished as follows. Salting-out agents, containing alkaline metal salts and/or alkaline earth metal salts and the like, are added to water comprising resinous particles as well as colorant particles as the coagulant at a concentration of higher than critical aggregation concentration. Subsequently, the resulting aggregation is heated above the glass transition point of said resinous particles so that fusion is carried out while simultaneously conducting salting-out.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Such a method is employed for controlling the particle distribution as classification, controlling of holding time or temperature during the coalescence, and termination method of coalescence.

Particularly preferable method is to control coagulation period, coagulation temperature, terminating speed. In the salting-out/fusion process, it is preferable that hold-over time after the addition of salting-out agents is as short as possible. The reason for this is not well understood. However, problems occur in which the aggregation state of particles varies depending on the hold-over time after salting out so that the particle diameter distribution becomes unstable and surface properties of fused toner particles varies.

Further, it is required that in the salting-out/fusion process, the temperature is quickly increased to glass transition point of the resin particles by heating. The period of increasing temperature is preferably within 30 minutes and more preferably within 10 minutes. The rate of temperature increase is preferably no less than 1° C./minute. The maximum rate of temperature increase is not particularly limited. However, from the viewpoint of minimizing the formation of coarse grains due to rapid salting-out/fusion, said rate is preferably not more than 15° C./minute.

Further, after the dispersion containing resinous particles and colorant particles is heated to a higher temperature than said glass transition point, it is important to continue the salting-out/fusion by maintaining the temperature of said dispersion for a specified period of time. By so doing, it is possible to effectively proceed with the growth of toner particles (aggregation of resinous particles as well as colorant particles) and fusion (disappearance of the interface between particles. As a result, it is possible to enhance the durability of the finally obtained toner.

It is possible to control the particle diameter specifically by employing di-valent metal salt during the process of coalescence to conduct salting out/fusing. It is assumed that repulsive force increases by employing the di-valent metal salt during the salting out process, whereby dispersion ability of a surfactant is inhibited effectively, and as a result, particle distribution is controlled.

To stop the salting out/adhesion by fusion process, it is preferable to add a mono-valent metal salt. The salting out can be stopped by the addition of such the salt. Thus the presence of excessively large diameter particles and excessively small diameter particles can be inhibited.

In the polymerized toner in which the resin particles are associated or adhered by fusion in the aqueous medium, the shape and the shape distribution of the toner particles can be optionally changed by controlling the flow of the medium and the temperature distribution in the reaction vessel, and further controlling the heating temperature, the rate of stirring and the duration of stirring in the shape controlling process.

In nother words, in the polymerized toner in which the resin particles are associated or adhered by fusion in the aqueous medium, a toner having the shape coefficient and the uniform shape distribution of the invention can be prepared by controlling the temperature, rate of stirring and duration of stirring using stirring wings and a stirring vessel capable of making the flow in the reacting vessel to a stratiform and unifying the temperature in the content of the vessel. It is supposed that the shape distribution of the particles adhered by fusion is made uniform since no strong stress is applied to the particles in the course of coagulation and adhesion by fusion (associated or coagulated particles) and the temperature distribution is uniform in the stratified flow in the stirring vessel when the adhesion by fusion of the particles is performed in the stratified flow. Thereafter, the adhered particles are gradually made sphere by heating and stirring in the shape controlling process. Thus the shape of the toner particles can be optimally controlled.

It is preferable for controlling the toner to a designated shape to progress the salting out and the adhesion at the same time. The distribution of the particle shape tends to be extended and formation of the small particles cannot be inhibited by a method in which heating is applied after the formation of the coagulated particles. It is assumed that small particles tend to form by breakup of the coagulated particle since the coagulated particles are stirred while heated.

Developer employed in this invention is described.

In such case that the toner is used as a two-component developer by blending with carrier, magnetic particles of the carrier such as metals such as iron, ferrite, magnetite, and the like, alloys of said metals with aluminum, lead and the like are employed. Specifically, ferrite particles are preferred. The volume average particle diameter of said magnetic particles is preferably 15 to 100 μm, and is more preferably 25 to 80 μm.

The volume average particle diameter of said carrier can be generally determined employing a laser diffraction type particle size distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

Figure 6:
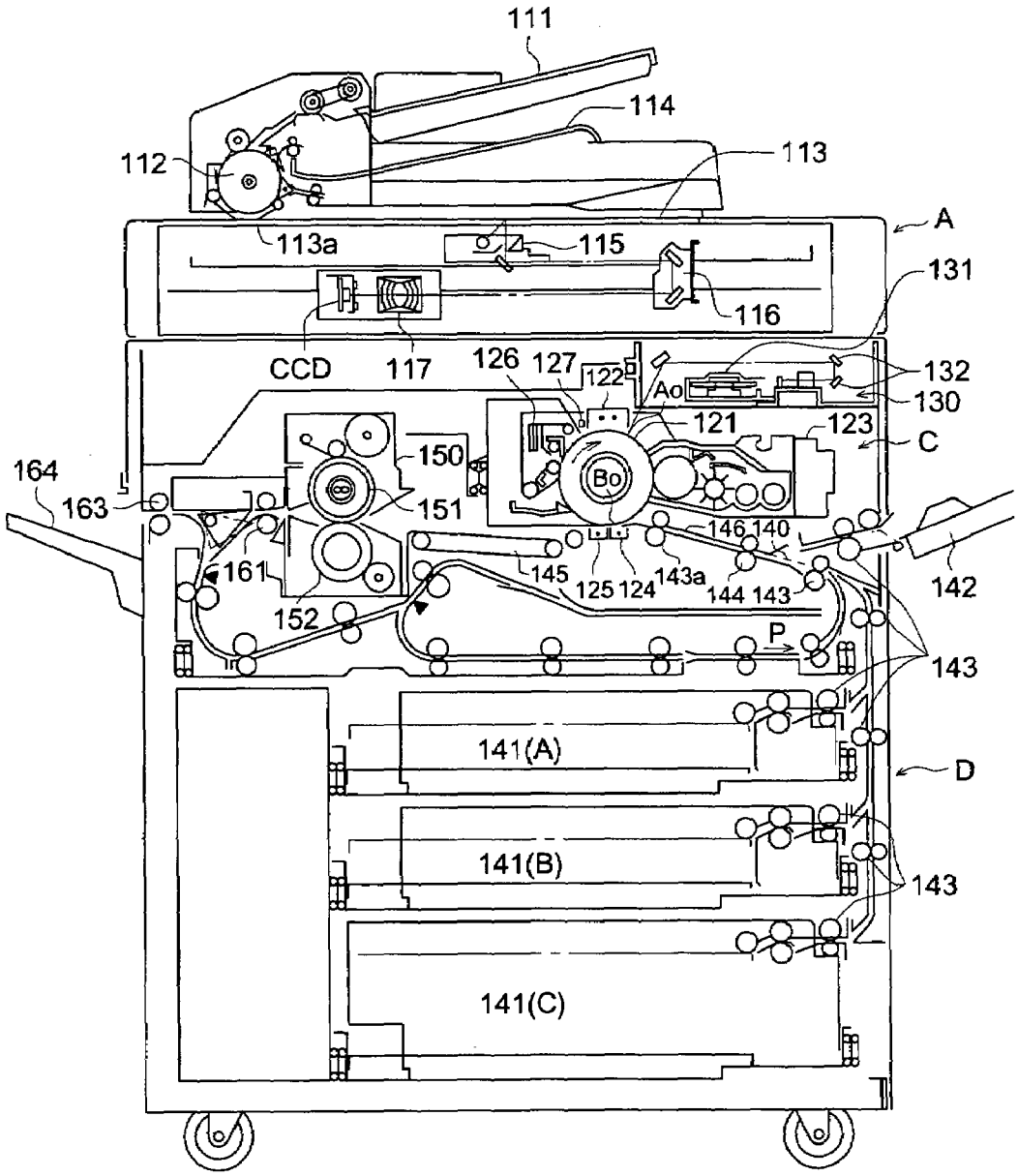
FIG. 6 is a sectional view schematically illustrating an example of an image forming apparatus used for the image forming method.

FIG. 6 is a cross-sectional view of an electrophotographic image forming apparatus as one example of the image forming apparatus of the present invention.

The image forming apparatus shown in FIG. 6 is one employing a digital system, and is comprised of image reading section A, image processing section B (not shown), image forming section C, and transfer paper conveying section D as the transfer paper conveying means.

In the upper part of image reading section A, provided is an automatic document conveying means which automatically conveys the original documents. Original documents, which are placed on document platen 111, are conveyed sheet by sheet and conveyed by original document conveying roller 112, and image reading is carried out at reading position 113*a*. The original document, which has been read, is ejected onto document ejecting tray 114, utilizing document conveying roller 112.

On the other hand, the image of the original document, which is placed on platen glass 13, is read by reading operation at a speed of v of first mirror unit 15 comprised of an illuminating lamp and a first mirror which constitutes an optical scanning system and by movement at a speed of v/2 in the same direction of second mirror unit 16 comprised of a second mirror and a third mirror which are positioned in a V letter.

The read image is focused through projection lens 117 onto the receptor surface of imaging sensor CCD of a line sensor. The linear optical image, which has been focused onto the imaging sensor CCD, is successively subjected to photoelectric conversion to obtain electric signals (brightness signals), and thereafter, is subjected to A/D conversion. The resultant signals are then subjected to various processes such as density conversion, a filtering process, and the like in image processing section B, and then the resultant image data are temporarily stored in a memory.

In image forming section C, arranged as image forming units are drum-shaped image bearing photoreceptor (hereinafter referred to as a photoreceptor drum) 121, and around said photoreceptor drum, charging unit 122 as the charging means, development unit 123 as the development means, transfer unit 124 as the transfer means, separating unit 125 as the separating means, cleaning unit 126 and PCL (precharge lamp) 127 in said order for each cycle. Photoreceptor 121 is prepared by applying photoconductive compounds onto a drum base body. For example, organic photoconductors (OPC) are preferably employed. Said drum rotates clockwise as shown in FIG. 6.

After rotating the photoreceptor is uniformly charged employing charging unit 122, image exposure is carried out based on image signals retrieved from the memory of image processing section B, employing exposure optical system 130. In said exposure optical system 130 which is utilized as the writing means, a laser diode (not shown) is employed as the light emitting source, and primary scanning is carried out in such a manner that light passes through rotating polygonal mirror 131, an fθ lens (having no reference numeral), and a cylindrical lens (also having no reference numeral), and the light path is deflected by reflection mirror 132. As a result, image exposure is carried out at position $A_0$ with respect to photoreceptor 121, and a latent image is formed by the rotation (secondary scanning) of photoreceptor 121. In one example of the present embodiment, exposure is carried out for a text section and the latent image is formed.

The latent image on photoreceptor 121 is subjected to reversal development employing development unit 123, and a visualized toner image is formed on the surface of said photoreceptor 121. In transfer sheet conveying section D, under the image forming unit provided are sheet supply units 142(A), 141(B), and 141(C) as paper sheet storing means, in which different-sized paper sheets P are stored, and provided on the exterior, is manual paper sheet supply unit 142 by which paper sheets are manually supplied. Paper sheet P, which is selected from any of these paper sheet supply units is conveyed along conveying path 140 employing paired guide rollers 143, and the conveyance of the paper sheet P is temporarily suspended by paired register rollers 144 which correct the inclination as well as the deviation of the paper sheet P, and thereafter the conveyance resumes again. Paper sheet P is guided by conveyance path 140, paired pre-transfer rollers 143*a*, and guide plate 146 so that the toner image on photoreceptor 121 is transferred onto paper sheet P at transfer position $B_0$ employing transfer unit 124. Subsequently, charge elimination is carried out employing separation unit 125; paper sheet P is separated from the surface of the photoreceptor 121 and is conveyed to fixing unit 150, employing conveying unit 145.

Fixing unit 150 comprises fixing roller 151 as well as pressure roller 152. By passing paper sheet P between fixing roller 151 and pressure roller 152, heat as well as pressure is applied to melt-fix the toner. Paper sheet P, which has been subjected to fixing of its toner image, is ejected onto paper sheet ejecting tray 64.

EXAMPLE

The following examples will further illustrate the invention.

Example 1

Preparation of Cylindrical Substrate

1. Manufacture of Substrate a. Manufacturing Method of Cylindrical Substrate A-1

Using a contact pressure controlling section 3 shown in FIG. 3, a stainless supporting member (length D=300 mm (0.84×L)) is pressed and held against the inner periphery of a cylindrical substrate (length L=344 mm, outside diameter=100 mm) of aluminum with a thickness of 2.00 mm made by drawing process. Then, the centering process was carried out with the outside diameter reference to have an inside diameter of 98.40 mm and a length 8 mm from the edge, using a precision CNC both-edge machining device (model BS manufactured by EGURO Inc.).

While the resulting cylinder was supported by a non-slidable chucks, the surface of the cylindrical substrate is machined by a turning process with the inside diameter reference of the centering processed portion (the turning machine: Model SPA-5 manufactured by Shoun Kosakusho Inc.) to obtain a cylindrical substrate A-1 having a surface roughness Rz (10 points surface roughness) of 0.7 μm and a cylindricity of 8 μm.

Definition of Surface Roughness at 10 Points Rz and Measurement Method Thereof

The surface roughness at 10 points Rz was measured in accordance with JIS B0601-1982 using a reference length of 0.25 mm. Thus, Rz is a difference between an average of the heights of the highest 5 peaks and an average of the depths of the lowest 5 valleys present in a reference length of 0.25 mm of the surface profile.

Rz was measured using a contact surface roughness tester (SURFCORDER SE-30D by Kosaka Laboratory Ltd.). Any other tester capable to give same results within an error range may be employed.

b. Manufacturing Method of Cylindrical Substrate A-2

The above procedures for the manufacture of cylindrical substrate A-1 were repeated in the same manner as described except that a supporting member having a length of 214 mm (0.60×L) was used, thereby obtaining a cylindrical substrate A-2 having a 10-point surface roughness Rz of 0.7 μm and a cylindricity of 25 μm.

c. Manufacturing Method of Cylindrical Substrate A-3

The above procedures for the manufacture of cylindrical substrate A-1 were repeated in the same manner as described except that a supporting member having a length of 143 mm (0.40×L) was used, thereby obtaining a cylindrical substrate A-3 having a 10-point surface roughness Rz of 0.7 μm and a cylindricity of 35 μm.

d. Manufacturing Method of Cylindrical Substrate A-4

The above procedures for the manufacture of cylindrical substrate A-1 were repeated in the same manner as described except that a supporting member having a length of 332 mm (0.93×L) was used, thereby obtaining a cylindrical substrate A-4 having a 10-point surface roughness Rz of 0.7 μm and a cylindricity of 28 μm.

e. Manufacturing Method of Cylindrical Substrate B-1 (Gripped from Outside)

Figure 7:
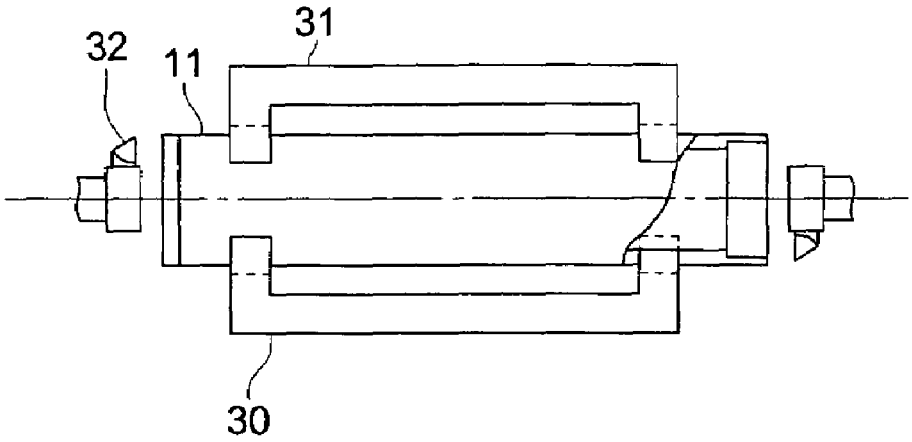
FIG. 7 shows an example of a central process in a substrate supported from outside.

The supporting member was not inserted into the cylindrical substrate, but was placed on a gripping member, that is, a fixing V-reception stand 30 from outside as shown in FIG. 7 (an example of the centering process for the substrate gripped from outside), and then fixed by a pressing V-reception holder 30 on a periphery of the cylindrical substrate 11. Thereafter, the centering process was performed by rotary drive turning bites 32 (a precision CNC both-edge machining device: model UB-600 manufactured by EGURO Inc.) on both of the right and left sides. Except that, the above procedures for the manufacture of cylindrical substrate A-1 were repeated in the same manner. The cylindrical substrate B-1 obtained has a 10-point surface roughness Rz of 0.7 μm and a cylindricity of 45 μm.

2. Manufacture of Photoreceptor:

The term "parts" represents "parts by mass".

Preparation of Photoreceptor 1

After washing cylindrical substrate A-1, an under coat layer, a CGL, a CTL were coated and dried by employing a dip coating apparatus shown by FIG. 5 in this order and Photoreceptor 1 was prepared. Gap of exit between solvent vapor reservoir and the drying hood was set 2 mm.

Under Coat Layer

Coating composition for the under coat layer was prepared by dispersing following component for 7 hour.

| | |
|---|---|
| Titanium chelate (average particle size of 0.2 μm, primary treated with alumina silica, and second treated with methylhydrogen polysiloxane) | 30 parts |
| Dainihon Ink And Chemicals Inc. M6401-50 | 16 parts |
| Dainihon Ink And Chemicals Inc. L145-60 | 4 parts |
| Methyethylketone | 100 parts |

The resulting coating composition of an interlayer was coated on the above-mentioned support to have an average dry thickness of 4 μm.

Charge Generating Later

| | |
|---|---|
| Y type titanylphthalocyanine (titanylphthalocyanine which has the maximum peak at 27.2 degrees of the Bragg angle 2θ (±0.2) by Cu-Kα characteristic-X-rays diffraction spectrum measurement) | 60 parts |

-continued

| | |
|---|---|
| Silicone-modified-butyral resin (X-40-1211M: manufactured by a Shin-Etsu Chemical Co., Ltd. company) | 700 parts |
| 2-butanone | 2000 parts |

The above-mentioned compositions were mixed and dispersed for 10 hours using the sand-mill so that a charge generation layer coating composition was prepared. This coating composition was coated by an impregnation coating method on the above-mentioned under coat layer, and a charge generation layer of 0.2 μm of thickness of dried coating layer was formed.

Charge Transporting Layer

| | |
|---|---|
| Charge transportation material (N-(4-methylphenyl)-N-(4-(β-phenylstyryl)phenyl-p-toluidine) | 225 parts |
| Polycarbonate (viscosity average molecular weight of 30.000) | 300 parts |
| Antioxidant (SANOL LS2626: manufactured by SANKYO CO., LTD. company) | 6 parts |
| Dichloromethane | 2000 parts |

The above-mentioned compositions were mixed and dissolved, thereby a charge transporting layer coating composition was prepared. The charge transporting layer of 25 μm of thickness of dried coating layer was formed with this coating composition by the immersion coating method on the above-mentioned charge generation layer.

Production of Photoreceptors 2-8

Photoreceptors 2-8 of Table 1 were produced as same as the production of Photoreceptor 1, except that the cylindrical substrate, species of titanium dioxide (particle diameter and surface treatment) and its amount in the under coating layer, and the gap of the coating apparatus were modified in the production of Photoreceptor 1. Thickness deviation and $PWS/P^2$ of the photoreceptors were measured by a way described afore, and the results are summarized in Table 1. The thickness deviation was measured for all layers provided on the substrate. The image forming width of the photoreceptors is 305 mm in the axis direction corresponding to the Konica digital copying machine 7060 used in the test.

TABLE 1

| | Substrate | | Titanium oxide in the Under coat layer | | | | | |
|---|---|---|---|---|---|---|---|---|
| Photoreceptor No. | No. | Cylindricity (μm) | Number average particle diameter (μm) | Surface treatment | Amount by parts | Gap of coating apparatus (mm) | $PWS/P^2$ ($10^{-4}$ $mm^{-1}$) | Thickness Deviation (μm) |
| 1 | A-1 | 8 | 0.2 | A | 30 | 1 | 0.9 | 1.2 |
| 2 | A-2 | 25 | 0.2 | A | 30 | 2 | 0.9 | 1.4 |
| 3 | B-1 | 45 | 0.2 | A | 30 | 1 | 0.85 | 2.5 |
| 4 | A-3 | 35 | 0.2 | A | 10 | 1 | 4.5 | 1.8 |
| 5 | A-1 | 8 | 0.2 | A | 5 | 1 | 5.3 | 1.2 |
| 6 | A-1 | 8 | — | — | 0 | 1 | 7.6 | 1.2 |
| 7 | A-4 | 28 | 0.05 | B | 30 | 2 | 2.1 | 1.6 |
| 8 | A-1 | 8 | 0.4 | C | 40 | 2 | 0.45 | 1.2 |

Surface treatment shown in Table 1 means below.

Treatment A: Primary treatment via alumina silica, and second treatment via methylhydrogenpolysiloxane Treatment B: Primary treatment via alumina zirconia, and second treatment via octyltrimethoxysiloxane Treatment C: Primary treatment via alumina silica, and second treatment via fluorotrimethoxysiloxane Preparation of Latex 1

A solution composed of 2760 g of purified water and 7.08 g of an anionic surfactant, sodium dodecylbenzenesulfonate, was placed into a 5000 ml separable flask on which a stirrer, temperature sensor, cooler and nitrogen gas introducing device were attached. Then the contents of the flask were heated to 80° C. while stirring at a rate of 230 rpm under the flow of nitrogen gas. Alternatively, 72.0 g of Exemplified Compound 19 was put into a monomer liquid composed of 115.1 g of styrene, 42.0 g of n-butyl acrylate, and 10.9 g of methacrylic acid and dissolved by heating at 80° C. The heated monomer liquid was placed into the flask and mixed with the surfactant solution after which it was dispersed by a mechanical dispersing machine having a cycling circuit to form emulsified particles of a uniform diameter. Then a solution of 0.48 g of a polymerization initiator, potassium persulfate (KPS), dissolved in 200 g of deionized water, was added to the emulsion. The resulting liquid was heated and stirred at 80° C. for 3 hours to prepare latex particles.

Thereafter, a solution of 0.84 g of the polymerization initiator KPS, dissolved in 240 ml of deionized water, was added to the above-prepared latex. After 15 minutes, a mixture of 383.6 g of styrene, 140.0 g of n-butyl acrylate, 36.4 g of methacrylic acid and 14.0 g of n-octyl 3-mercaptopropionate was gradually dripped into the latex over 120 minutes at 80° C. After completion of the dropping, the resulting liquid was further heated and stirred for 60 minutes and then cooled to 40° C. to obtain latex particles.

These latex particles are referred to as Latex 1.

Preparation of Colored Particles

Preparation of Colored Particles 1Bk

In 160 ml of deionized water, 9.2 g of sodium n-dodecylsulfate was dissolved with stirring. Into this solution, 20 g of carbon black REGAL 330R, produced by Cabot Co., Ltd., was gradually added while stirring and dispersed in a dispersing machine CLEAMIX. The particle size of the dispersed particles measured by an electrophoresis scatter light meter ELS-800, manufactured by Otsuka Electronics Co., Ltd., was 112 nm in weight average particle diameter. This dispersion is referred to as Colorant Dispersion 1.

Into a 5 liter four-mouth flask, to which a temperature sensor, cooler, nitrogen gas introducing device and stirrer were attached, 1250 g of Latex 1, 2000 ml of deionized water and Colorant Dispersion 1 were placed, and then stirred. After adjusting the temperature to 30° C., pH value of the mixture was adjusted to 10.0 by adding a 5 moles/liter sodium hydroxide solution. Then a solution of 52.6 g of magnesium chloride hexahydrate dissolved in 72 ml of deionized water was added at 30° C. over 5 minutes while stirring. The resultant was stood for 2 minutes and heated to 50° C. over 5 minutes; the temperature raising rate was 12° C./minute. In such a situation, the particle size was measured by Coulter Counter TA III and the growth of the particles was stopped by adding a solution of 115 g of sodium chloride dissolved in 700 ml of deionized water at the time when the volume average diameter of the particles reached 4.3 μm. The mixture was further stirred for 8 hours at a temperature of 85±2° C. for salting off/adhesion by fusion of the particles. Thereafter, the system was cooled to 30° C. at a cooling rate of 6° C./minute; then the pH was adjusted to 2.0 by addition of hydrochloric acid, and stirring was stopped. Thus formed colored particles were filtered and washed, and dried by air heated to 40° C. The thus obtained colored particles are referred to as Colored Particles 1Bk.

Preparation of Colored Particles 2Bk, 3Bk, 4Bk and 5Bk

Colored Particles 2Bk through 5Bk were prepared in the same manner as Colored Particles Bk1 except that the preparation condition was changed as shown in Table 1.

Preparation of Colored Particles 6Bk through 8Bk

Colored Particles 6Bk through 8Bk were prepared in the same manner as Colored Particles 1Bk except that the preparation condition was set as shown in Table 2, and the particle growth was stopped when the volume average particle diameter reached 3.8 μm.

Preparation of Colored Particles 9Bk through 11Bk

Colored Particles 9Bk through 11Bk were prepared in the same manner as Colored Particles 1Bk except that the preparation condition was set as shown in Table 2, and the particle growth was stopped when the volume average particle diameter reached particle diameter less than Dv50 shown in Table 3 by 0.2 to 0.3 μm.

Preparation of Colored Particles 12Bk and 13Bk

Colored Particles 12Bk and 13Bk were prepared in the same manner as Colored Particles 1Bk except that the preparation condition was set as shown in Table 2, and the particle growth was stopped when the Dv50 reached 3 by 2.6 and 7.1 μm, respectively.

The preparation conditions of Colored Particles 1Bk through 13Bk are shown in Table 2.

TABLE 2

| | | | Salt off/adhesion by fusion | |
|---|---|---|---|---|
| Colored Particle No. | Added amount of magnesium chloride (g) | Temperature raising rate (° C./minute) | Temperature of suspension | Duration time (hour) |
| 1Bk | 52.6 | 12 | 85 ± 2° C. | 8 |
| 2Bk | 52.6 | 20 | 90 ± 2° C. | 6 |
| 3Bk | 52.6 | 5 | 90 ± 2° C. | 6 |
| 4Bk | 26.3 | 12 | 85 ± 2° C. | 8 |
| 5Bk | 78.9 | 12 | 85 ± 2° C. | 8 |
| 6Bk | 52.6 | 12 | 85 ± 2° C. | 8 |
| 7Bk | 43.3 | 12 | 85 ± 2° C. | 8 |
| 8Bk | 78.9 | 12 | 85 ± 2° C. | 8 |
| 9Bk | 52.6 | 12 | 85 ± 2° C. | 8 |
| 10Bk | 35.5 | 12 | 85 ± 2° C. | 8 |
| 11Bk | 78.9 | 12 | 85 ± 2° C. | 8 |
| 12Bk | 52.6 | 12 | 85 ± 2° C. | 8 |
| 13Bk | 52.6 | 12 | 85 ± 2° C. | 8 |

TABLE 3

| Colored Particle | Volume average 50% particle diameter (Dv50) (μm) | Number average 50% particle diameter (Dp50) (μm) | Dv50/Dp50 | Cumulative volume of particles up to 75% (Dv75) (μm) | Cumulative number of particles up to 75% (Dp75) (μm) | Dv75/Dp75 | Number of particles having particle diameter of not more than 0.7 × Dp50 in % |
|---|---|---|---|---|---|---|---|
| 1Bk | 4.6 | 4.3 | 1.07 | 4.1 | 3.7 | 1.11 | 7.8 |
| 2Bk | 4.8 | 4.5 | 1.07 | 4.2 | 3.7 | 1.14 | 5.5 |
| 3Bk | 4.5 | 4.1 | 1.10 | 4.0 | 3.4 | 1.18 | 8.2 |
| 4Bk | 4.6 | 3.7 | 1.24 | 4.1 | 3.1 | 1.32 | 13.6 |
| 5Bk | 4.7 | 4.3 | 1.09 | 4.1 | 3.6 | 1.14 | 6.3 |
| 6Bk | 3.9 | 3.7 | 1.05 | 3.3 | 2.8 | 1.18 | 6.8 |
| 7Bk | 3.8 | 3.4 | 1.12 | 3.2 | 2.7 | 1.18 | 11.3 |

TABLE 3-continued

| Colored Particle | Volume average 50% particle diameter (Dv50) (μm) | Number average 50% particle diameter (Dp50) (μm) | Dv50/Dp50 | Cumulative volume of particles up to 75% (Dv75) (μm) | Cumulative number of particles up to 75% (Dp75) (μm) | Dv75/Dp75 | Number of particles having particle diameter of not more than 0.7 × Dp50 in % |
|---|---|---|---|---|---|---|---|
| 8Bk | 3.9 | 3.8 | 1.03 | 3.3 | 2.8 | 1.18 | 6.3 |
| 9Bk | 5.6 | 5.3 | 1.06 | 5.1 | 4.5 | 1.13 | 8.5 |
| 10Bk | 5.5 | 4.8 | 1.15 | 4.9 | 4.0 | 1.23 | 12.5 |
| 11Bk | 5.7 | 5.4 | 1.06 | 5.1 | 4.4 | 1.16 | 6.3 |
| 12Bk | 2.8 | 2.5 | 1.12 | 2.4 | 2.2 | 1.09 | 8.7 |
| 13Bk | 7.3 | 6.9 | 1.06 | 6.5 | 6.0 | 1.08 | 7.0 |

Preparation of Toner Particles

To each of Colored Particles Bk1 through Bk13, 1% by weight of hydrophobic silica having a number average primary particle diameter of 12 nm and a hydrophobicity of 68 and 0.5% by weight of hydrophobic titanium oxide having a number average primary particle diameter of 20 nm and a hydrophobicity of 63 were added and mixed by a Henschel mixer. Thus Toner Particles 1Bk through Bk13 were obtained.

The shape and physical properties of each of these toners were the same as those described in Table 3.

Preparation of Developer

To each of the toners, a ferrite carrier particle which was coated by silicone resin and has a volume average diameter of 60 μm was added and mixed. Thus Developers 1Bk through 13Bk were obtained each having a toner concentration of 6%.

Evaluation

Images are formed employing Konica 7060 digital copying machine, manufactured by Konica Corp., employing a combination of each of the foregoing photoreceptors, developers and electrical field intensities as shown in Table 4. The identification number of the developer was the same as that of the toner used in the developer. Resultant images were compared and evaluated.

Circumferential rate of the photoreceptor: 370 mm/sec

Charging Condition

Charging unit: scorotron charging unit; the initial charge potential was set at −750 V.

Exposure Condition

The exposure by semiconductor laser having 680 nm, the amount being set so as to obtain an exposure section potential of −50 V.

Development Conditions

DC bias: −550 V

Dsd: 550 μm

Developer layer regulation: edge-cut system

Developer layer thickness: 700 μm

Development sleeve diameter: 40 mm

Transfer Condition

Transfer electrode: corona charging system, electric current of a transfer dummy; 45 μA Cleaning Conditions Cleaning blades was pressed in counter direction to photoreceptor rotation with line pressure of 20 N/m.

An A4 size original image including a character image having a pixel ratio of 7%, a halftone image, a solid white and a solid black image each occupying a quarter area of the image was continuously copied employing 100,000 sheets at usual temperature and humidity, 24° C. and 60' relative humidity.

Evaluation of Moire (11 Copies from First Copy and Every 10,000th Copying up to 100,000th Copying)

A: No Moire was observed up to 100,000th copy (Excellent)

B: Slight Moire was observed at initial copy (Available for practical use)

C: Marked Moire was found from initial stage or during test (Problematic in practical use)

D: Marked Moire was found throughout test (Problematic in practical use)

Cleaning Evaluation (100,000 sheets of A-3 size copying, and cleaning defects at white solid part)

A: No cleaning deficiency was observed up to 100,000th sheet. (Excellent)

B: Slight non-uniform image was observe just before 100,000th sheet. (Available for practical use)

C: Non-uniform image was observed not more than 30,000 th sheet. (Problematic in practical use)

Sharpness

The sharpness of the image was performed with respect to the images formed after 100,000 sheets copying. Images of 3- and 5-point characters were printed and evaluated according to the following norms.

A: Both of the 3- and 5-point characters printed were clear and easily readable. (Satisfactory)

B: A part of the 3-point characters formed was not readable and the 5-point characters were clear and easily readable. (Practically available)

C: The 3-point characters formed were almost not readable and a part or all were not readable. (Practically unavailable) Reproducing Ability of Dot Line Reproducing ability of half tone dot line image was evaluated by fluctuation of 400 dpi line position formed by 4 dots in the image area having image density of 0.5.

Figure 8:
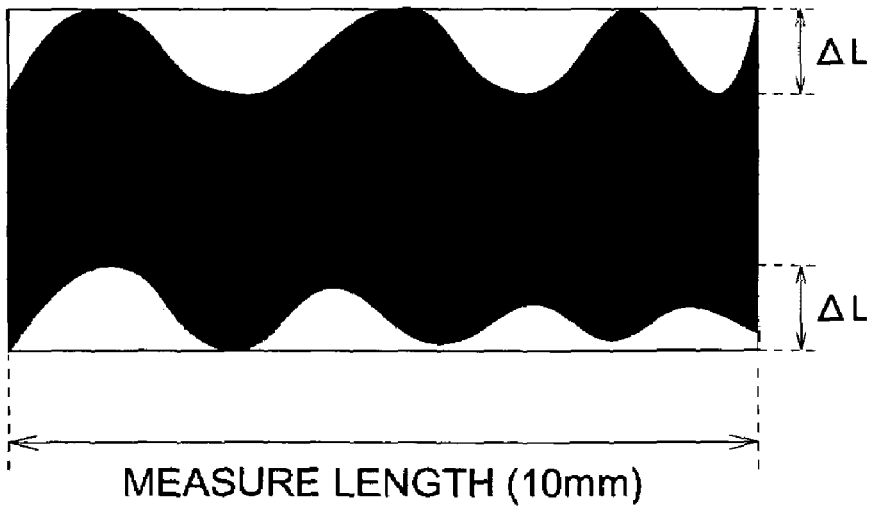
FIG. 8 illustrates fluctuation of line position at the edge portion schematically.

FIG. 8 illustrates fluctuation of line position at the edge portion schematically. The fluctuation is a difference ΔL between parallel straight lines having 10 mm length drawn contacting with maximum convex points and minimum concave points of images formed by 4 dots.

Measuring apparatus: Image analyzer manufactured by Yaman Co., measure length being 10 mm.

A: ΔL being not more than 20 μm.

B: ΔL being more than 20 μm and not more than 30 μm.

C: ΔL being more than 30 μm and not more than 60 μm.

D: ΔL being more than 60 μm.

Sample ranked C need detailed evaluation and ranked D is not practically available.

TABLE 4

| Test No. | Photoreceptor | Developer No. | Evaluation | | | |
|---|---|---|---|---|---|---|
| | | | Moire | Cleaning | Sharpness | Reproduction of dotted line |
| 1 | 1 | 1Bk | A | A | A | A |
| 2 | 2 | 2Bk | A | A | A | A |
| 3 | 3 | 3Bk | B | C | C | C |
| 4 | 4 | 4Bk | B | C | C | D |
| 5 | 5 | 5Bk | D | B | C | D |
| 6 | 6 | 6Bk | D | B | C | D |
| 7 | 1 | 7Bk | B | C | C | C |
| 8 | 2 | 8Bk | A | A | A | A |
| 9 | 3 | 9Bk | B | C | C | C |
| 10 | 4 | 10Bk | B | C | C | D |
| 11 | 5 | 11Bk | D | B | C | D |
| 12 | 1 | 12Bk | A | B | A | A |
| 13 | 2 | 13Bk | A | A | B | B |
| 14 | 4 | 1Bk | B | A | B | B |
| 15 | 1 | 5Bk | A | A | A | A |
| 16 | 1 | 6Bk | A | A | A | A |
| 17 | 2 | 11Bk | A | A | A | A |
| 18 | 7 | 1Bk | B | A | B | B |
| 19 | 8 | 2Bk | A | A | A | A |

The result shown in Table 4 demonstrates that each sample 1, 2, 8, and 12-19, which are combination of the photoreceptor having deviation of layer thickness of 1.4 to 1.8 μm and specified $PWS/P^2$ with toner having specified particle size distribution prevents generation of moiré and has good cleaning characteristics, sharpness, reproduction of dotted line. Sample 3 or 9 employing a photoreceptor having cylindricity of 45 μm and deviation of layer thickness of 2.5 μm shows lower cleaning characteristics and sharpness as well as deteriorated reproduction of dotted line. Sample 5, 6 or 11, which has $PWS/P^2$ fallen outside of formula 1, shows marked moiré, and deteriorated sharpness and reproduction of dotted line. Sample 4, 7 or 10, which employs toner having particle size distribution fallen outside of the invention, lower sharpness as a result of deteriorated cleaning characteristics and reproduction of dotted line.

Example 2

The photoreceptor samples were employed as Example 1. (Toner Production Example 21: Example of an Emulsion Polymerization Association Method)

Added to 10.0 liters of pure water was 0.90 kg of sodium dodecylsulfate, which was dissolved while stirring. Slowly added to the resulting solution was 1.20 kg of Regal 330R (carbon black, manufactured by Cabot Co.), and the resulting mixture was thoroughly stirred for one hour, and thereafter, was continually dispersed for 20 hours employing a sand grinder (a medium type homogenizer). The resulting dispersion was denoted as "Colored Dispersion 1".

A solution comprised of 0.055 kg of sodium dodecylbenzenesulfonate and 4.0 liters of deionized water is denoted as "Anionic Surface Active Agent Solution A".

A solution comprised of 0.014 kg of nonylphenolpolyethylene oxide 10-mole addition product and 4.0 liters of deionized water is labeled as "Nonionic Surface Active Agent Solution B", while A solution prepared by dissolving 223.8 g of potassium persulfate in 12.0 liters of deionized water is labeled as "Initiating Solution C".

Added to 100 liters of a GL (glass lining) reaction vessel equipped with a temperature sensor, a cooling pipe, and a nitrogen gas introducing unit were 3.41 kg of WAX emulsion (polypropylene emulsion having a number average molecular weight of 3,000, and having a number average primary particle diameter of 120 nm/a solid portion concentration of 29.9%), all of "Anionic Surface Active Agent A", and all of "Nonionic surface Active Agent Solution B", and the resulting mixture was stirred. Subsequently, 44.0 liters of deionized water were added.

The resulting mixture was heated and when it reached 75° C., all of "Initiator Solution C" was added dropwise. Thereafter, while controlling the temperature at 75±1° C., 12.1 kg of styrene, 2.88 kg of n-butyl acrylate, 1.04 kg of methacrylic acid, and 548 g of t-dodecylmercaptan were added dropwise. After completing of dropwise addition, the resulting mixture was heated to 80±1° C., and stirred for 6 hours while maintaining said temperature. Subsequently, the mixture was cooled below 40° C. and stirring was terminated. Filtration was then carried out employing a pole filter and the resulting filtrate was labeled as "Latex A".

Further, the resin particles in Latex A had a glass transition temperature of 57° C., a softening point of 121° C., and regarding the molecular weight distribution, a weight average molecular weight of 12,700 and a weight average particle diameter of 120 nm.

Furthermore, a solution prepared by dissolving 0.055 kg of sodium dodecylbenezensulfonate in 4.0 liters of deionized water was designated as "Anionic Surface Active Agent solution D", while a solution prepared by dissolving 0.014 kg of nonylphenolpolyethylene oxide 10-mole addition product in 4.0 liters of deionized water was denoted as "Nonionic Surface Active Agent E".

A solution prepared by dissolving 200.7 g of potassium persulfate (manufactured by Kanto Kagaku Co.) in 12.0 liters of deionized water was labeled as "Initiator Solution F".

Added to 100 liters of a GL reaction vessel equipped with a temperature sensor, a cooling pipe, a nitrogen gas introducing unit, and a comB-shaped baffle, were 3.41 kg of WAX emulsion (polypropylene emulsion having a number average molecular weight of 3,000, having a number average primary particle diameter of 120 nm and a solid portion concentration of 29.9%), all of "Anionic Surface Active Agent D", and all of "Nonionic Surface Active Agent Solution E", and the resulting mixture was stirred. Subsequently, 44.0 liters of deionized water were added.

The resulting mixture was heated and when heated to 70° C., "Initiator Solution F" was added. Thereafter, 11.1 kg of styrene, 4.00 kg of n-butyl acrylate, 1.04 kg of methacrylic acid, and 9.02 g of t-dodecylmercaptan were previously mixed and added dropwise. After completing of dropwise addition, the resulting mixture was controlled to 72±2° C., and stirred for 6 hours. Further, after being heated to 72±2° C., stirring was continued for 12 hours while maintaining said temperature. Subsequently, the temperature was lowered below 40° C. and stirring was terminated. Filtration was then carried out employing a pole filter and the resulting filtrate was labeled as "Latex B".

Further, it was found that the resin particles in Latex B had a glass transition temperature of 58° C., a softening point of 132° C., and regarding the molecular weight distribution, a weight average molecular weight of 245,000 and a weight average particle diameter of 110 nm.

A solution prepared by dissolving 5.36 kg of sodium chloride in 20.0 liters of deionized water was labeled as "Sodium Chloride Solution G".

A solution prepared by dissolving 1.00 g of a fluorine based nonionic surface active agent in 1 l of deionized water was labeled as "Nonionic Surface Active Agent Solution H".

Added to a stainless steel reaction vessel (with constitution of the stirrer blades having the angle of the blade of 25 degree as shown in FIG. 6) equipped with a temperature sensor, a cooling pipe, a nitrogen gas introducing unit, a monitoring unit for the particle diameter and shape, were 20.0 kg of Latex A, 5.2 kg of Latex B, and 0.4 kg of dispersion of colorant, which were prepared as described above, and 20.0 kg of deionized water, and the resulting mixture was stirred. Subsequently the mixture was heated to 40° C., and Sodium Chloride Solution G, 6.00 kg of isopropanol (manufactured by Kanto Kagaku Co.), and Nonionic Surface Active Agent Solution H were added in that order. Thereafter, after the resulting mixture was left for 10 minutes, it was heated to 85° C. over 60 minutes. While maintaining the temperature at 85±2° C. while stirring, salting out/fusion were carried out to increase the particle diameter. Next, 2.1 liters of deionized water were added to terminate the growth of the particle diameter to form fused particle dispersion.

Added to reaction vessel 5 liters equipped with a temperature sensor, a cooling pipe, and a monitoring unit for the particle diameter and shape were 5.0 kg of fused particle dispersion prepared as described above, and at 85±2° C., the dispersion was stirred for 0.5 to 15 hours to control the particle shape. Thereafter, the resulting dispersion was cooled below 40° C., and stirring was stopped. Subsequently, employing a centrifuge, classification was carried out of the liquid employing a centrifugal sedimentation method. The resulting liquid was filtered employing a sieve having a sieve opening of 45 μm, and the filtrate was labeled as Association Liquid. Subsequently, employing a Buchner funnel, non-spherical particles in a wet cake were collected from Association Liquid employing filtration. Thereafter, those particles were washed with deionized water. The resulting non-spherical particles were dried at an intake air temperature of 60° C. employing a flash jet dryer, and were then dried at 60° C. employing a fluid layer dryer. Externally mixed with 100 weight parts of the prepared colored particles was one weight part of fine silica particles employing a Henschel mixer to obtain the toner employing the emulsion polymerization method.

Toners 1 through 16 were prepared in such a manner that during the above-mentioned salting out/fusion stage and monitoring of the shape controlling process, by controlling the stirrer rotation frequency as well as the heating time, the shape as well as the variation coefficient of the shape coefficient was controlled, and further, employing classification in the liquid, the particle diameter as well as the variation coefficient of the particle size distribution was optionally regulated. The properties of toners 21 to 36 are shown in Table 5.

TABLE 5

| Toner | Toner Characteristics (1) | Toner Characteristics (2) | Toner Characteristics (3) | Toner Characteristics (4) | Toner Characteristics (5) | $M(m_1 + m_2)$ (%) |
|---|---|---|---|---|---|---|
| 21 | 68.3 | 15.2 | 88 | 5.6 | 25.9 | 80.7 |
| 22 | 73.2 | 12.2 | 94 | 8.1 | 20.7 | 82.3 |
| 23 | 65.1 | 14.8 | 52 | 4.1 | 26.6 | 71.4 |
| 24 | 63.4 | 15.7 | 51 | 5.3 | 26.1 | 70.5 |
| 25 | 67.7 | 16.8 | 53 | 5.6 | 26.5 | 72.4 |
| 26 | 67.7 | 15.2 | 46 | 5.6 | 25.9 | 80.7 |
| 27 | 74.1 | 12.4 | 89 | 5.7 | 27.8 | 71.6 |
| 28 | 65.1 | 15.0 | 51 | 5.6 | 25.6 | 67.4 |
| 29 | 60.2 | 17.2 | 53 | 5.7 | 25.8 | 70.5 |
| 30 | 66.1 | 16.9 | 42 | 5.7 | 22.0 | 79.8 |
| 31 | 65.1 | 17.7 | 55 | 5.5 | 27.7 | 71.0 |
| 32 | 67.7 | 16.8 | 53 | 5.6 | 26.2 | 68.2 |
| 33 | 62.1 | 15.1 | 40 | 7.7 | 26.0 | 68.2 |
| 34 | 62.5 | 17.2 | 53 | 8.2 | 25.8 | 67.8 |
| 35 | 60.5 | 17.8 | 42 | 5.7 | 26.2 | 68.3 |
| 36 | 61.5 | 18.0 | 44 | 8.8 | 28.4 | 65.3 |

Toner Characteristics (1) through (5) notes as follows.

(1) Number ratio of toner particles having shape coefficient of 1.2 to 1.6 in percent.

(2) Variation coefficient of the shape coefficient in percent.

(3) Number ratio of toner particles having no corners in percent.

(4) Number average particle diameter.

(5) Variation coefficient of number distribution of particle diameter.

Preparing of Developer

Developers 21 to 36 for the evaluation were prepared by mixing each of 10 parts of the toners 21 to 36 with 100 parts of ferrite carriers coated with styrene-methacrylate copolymer having average diameters of 45 μm.

Evaluation

Employing Photoreceptors 1 through 8 and Developers 21 through 36, each of the combinations was evaluated employing a digital copier Konica 7060 manufactured by Konica Corp. as a copier for evaluation.

Image Forming Condition of the Above Machine

Peripheral speed of the photoreceptor: 370 mm/sec

Charger: Scorotron charger, initial potential: −750 V

Exposure Condition

Image exposure light source: Semiconductor laser, 680 nm Exposure strength was set to have potential −50 V at exposed portion.

Developing Condition

DC bias: −550 V

Dsd: 550 μm

Developer layer thickness regulation: Edge cut method

Developer layer thickness: 700 μm

Diameter of developer sleeve: 40 mm

Transfer Condition

Transfer pole: Corona charging method, transfer dummy current: 45 μA

Cleaning Condition

Cleaning blade was pressed at line pressure of 20 N/m in counter direction to direction of photoreceptor rotation.

Evaluation was made by copying an original document having four equal quarter parts of a text having a pixel ratio of 7%, a portrait, a solid white image, and a solid black image, employing A4 neutral paper sheets. The original document was continuously copied employing 100,000 sheets at usual temperature and humidity, 24° C. and 60% relative humidity. Evaluation items as well as evaluation criteria are shown below.

Evaluation of Moire (11 copies from first copy and every 10,000th copying up to 100,000th copying)

A: No Moire was observed up to 100,000th copy (Excellent)

B: Slight Moire was observed at initial copy (Available for practical use)

C: Marked Moire was found from initial stage or during test (Problematic in practical use)

D: Marked Moire was found throughout test (Problematic in practical use)

Cleaning Evaluation (100,000 sheets of A-3 size copying, and cleaning defects at white solid part)

A: No cleaning deficiency was observed up to 100,000th sheet. (Excellent)

B: Slight non-uniform image was observe just before 100,000th sheet. (Available for practical use)

C: Non-uniform image was observed not more than 30,000 th sheet. (Problematic in practical use)

Sharpness

The sharpness of the image was performed with respect to the images formed after 100,000 sheets copying. Images of 3- and 5-point characters were printed and evaluated according to the following norms.

A: Both of the 3- and 5-point characters printed were clear and easily readable. (Satisfactory)

B: A part of the 3-point characters formed was not readable and the 5-point characters were clear and easily readable. (Practically available)

C: The 3-point characters formed were almost not readable and a part or all were not readable. (Practically unavailable)

Reproducing Ability of Dot Line

Reproducing ability of half tone dot line image was evaluated by fluctuation of 400 dpi line position formed by 4 dots in the image area having image density of 0.5.

Measuring apparatus: Image analyzer manufactured by Yaman Co., measure length being 10 mm.

A: ΔL being not more than 20 μm.

B: ΔL being more than 20 μm and not more than 30 μm.

C: ΔL being more than 30 μm and not more than 60 μm.

D: ΔL being more than 60 μm.

Sample ranked C need detailed evaluation and ranked D is not practically available. The result is summarized in Table 6.

TABLE 6

| | Evaluation | | | |
|---|---|---|---|---|
| Photoreceptor No. | Moire | Cleaning | Sharpness | Reproduction of dotted line |
| 1 | A | A | A | A |
| 2 | A | A | A | A |
| 3 | B | C | C | C |
| 4 | B | A | B | B |
| 5 | D | B | C | D |
| 6 | D | A | C | D |
| 7 | A | A | A | A |
| 8 | A | A | A | A |

The photoreceptor samples 1, 2, 4, 7 and 8, each of which has cylindricity between 8 and 35 μm and deviation of layer thickness between 1.2 and 1.8 μm, did not generate moiré were good in cleaning characteristics, sharpness and reproduction of fine dotted line. The photoreceptor sample 3 having cylindricity of 45 μm and deviation of layer thickness of 2.5 μm showed lower sharpness and deteriorated in reproduction of fine dotted line. The photoreceptor samples 5 and 6 having $PWS/P^2$ fallen outside of formula 1 result marked moiré and deteriorated sharpness and reproduction of dotted line.

Evaluation

Images are formed employing Konica 7060 digital copying machine, manufactured by Konica Corp., employing a combination of each of the foregoing photoreceptors 1-8, and developers 22-36 as shown in Table 7, and same evaluation as above was performed. The result is summarized in Table 7.

TABLE 7

| Test No. | Photo-receptor No. | Developer No. | Moire | Cleaning | Sharpness | Repro-duction of dotted line |
|---|---|---|---|---|---|---|
| 21 | 2 | 2 | A | A | A | A |
| 22 | 2 | 3 | A | A | A | A |
| 23 | 2 | 4 | A | B | B | A |
| 24 | 2 | 5 | A | B | B | A |
| 25 | 2 | 6 | A | A | B | B |
| 26 | 2 | 7 | A | B | B | A |
| 27 | 2 | 8 | A | B | B | A |
| 28 | 2 | 9 | A | B | B | A |
| 29 | 2 | 10 | A | B | B | B |
| 30 | 2 | 11 | A | B | B | A |
| 31 | 2 | 12 | A | B | B | A |

TABLE 7-continued

| Test No. | Photo-receptor No. | Developer No. | Moire | Cleaning | Sharpness | Repro-duction of dotted line |
|---|---|---|---|---|---|---|
| 32 | 2 | 13 | A | B | B | B |
| 33 | 2 | 14 | A | B | B | B |
| 34 | 2 | 15 | A | C | B | D |
| 35 | 2 | 16 | A | C | B | D |
| 36 | 3 | 3 | B | C | C | D |
| 37 | 4 | 3 | B | A | B | A |
| 38 | 5 | 3 | D | B | C | D |
| 39 | 6 | 3 | D | A | C | D |
| 40 | 7 | 3 | A | A | A | B |
| 41 | 8 | 3 | A | A | A | B |

As is evident from Table 7, combination Nos. 21-36 and 28-41 in which a cylindrical photoreceptor having a cylindricity of 5 to 40 μm is used in conjunction with a toner sufficing at least one of the following conditions (1) to (5) exhibit superior image density, resolution, cleaning efficiency, halftone evenness and toner transferability as compared with combination Nos. 17 and 22 which do not meet with the these conditions. Especially Nos. 21 to 23 and 38 to 41 that sufficing all the conditions (1) to (5) exhibit excellent results.

(1) toner includes toner particles having a variation coefficient of shape coefficient of not more than 16%.

(2) A toner includes at least 65% of toner particles having a shape coefficient in the range of 1.2 to 1.6.

(3) A toner includes at least 50% of toner particles in number having no corner.

(4) A toner includes toner particles having a number variation coefficient in the number particle size distribution of not more than 27%.

(5) A toner has M of at least 70%, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of 0.23, and number of particles is used as an ordinate.

As is apparent from the examples described above, in the image forming method meeting the conditions the above, can attain good cleaning efficiency and can afford sharp images having good image evenness.

The invention claimed is:

1. An image forming method comprising:

developing a latent image formed on an organic photoreceptor, with a developer comprising a toner having a variation coefficient of shape coefficient of not more than 16%, wherein the organic photoreceptor comprises a cylindrical substrate and a layer covering the substrate including a photosensitive layer, wherein the cylindrical substrate has a cylindricity of 5 to 40 μm, and the photoreceptor satisfies the relation of $$0<(PWS/P^2)<5.0\times10^{-4}\ \mathrm{mm}^{-1},$$

wherein PWS is an average value of power spectrum values of regular reflection light amount in a region of a space frequency from 0 to 2 $\mathrm{mm}^{-1}$ measured at the wave length of imagewise exposing light to the photoreceptor, and P is an average value of reflection light at the measuring point of the photoreceptor.

2. The method of claim 1, wherein the toner includes at least 65% of toner particles having a shape coefficient in the range of 1.2 to 1.6.

3. The method of claim 1, wherein the toner includes at least 50% of toner particles in number having no corner.

4. The method of claim 1, wherein toner has a number variation coefficient in the number particle size distribution of not more than 27%.

5. The method of claim 1, wherein the toner has M of at least 70%, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

6. The method of claim 5, wherein the toner includes at least 65% of toner particles having a shape coefficient in the range of 1.2 to 1.6.

7. The method of claim 1, wherein the toner has a number average particle diameter of 3 to 8 μm.

8. The method of claim 1, wherein the toner has a ratio (Dv50/Dp50) from 1.0 to 1.15, wherein (Dv50) is the 50% volume particle diameter and (Dp50) is the 50% number particle diameter.

9. The method of claim 1, wherein the toner has a ratio (Dv75/Dp75) of 1.00 to 1.12, wherein Dv75 is the cumulative 75% volume particle diameter from the maximum diameter of the toner particle and Dp75 is the cumulative 75% number particle diameter.

10. The method of claim 1, wherein the toner contains toner particles having variation coefficient of a shape coefficient of not more than 16% and number variation coefficient of number distribution of particle diameter of 27%.

11. The image forming method, comprising: developing a latent image formed on a photoreceptor, with a developer comprising a toner, wherein the organic photoreceptor comprises a cylindrical substrate and a layer covering the substrate including a photosensitive layer, wherein the cylindrical substrate has a cylindricity of 5 to 40 μm, and the photoreceptor satisfies the relation of $$0<(PWS/P^2)<5.0\times10^{-4}\ \mathrm{mm}^{-1},$$

wherein PWS is an average value of power spectrum values of regular reflection light amount in a region of a space frequency from 0 to 2 $\mathrm{mm}^{-1}$ measured at the wave length of imagewise exposing light to the photoreceptor, and P is an average value of reflection light at the measuring point of the photoreceptor.

12. The method of claim 11, wherein $PWS/P^2$ is not larger than $1.0\times10^{-4}\ \mathrm{mm}^{-1}$.

13. The method of claim 11, wherein the organic photoreceptor comprises an under coat layer between the substrate and the photosensitive layer containing inorganic particles having a number average primary particle diameter of from 0.02 to 0.5 μm.

14. The method of claim 11, wherein deviation of layer thickness of the layer covering the substrate in the substantial image forming area is from 0.2 to 2.0 μm.

* * * * *